US011166344B2

(12) United States Patent
Andrew et al.

(10) Patent No.: US 11,166,344 B2
(45) Date of Patent: Nov. 2, 2021

(54) ELECTRICALLY-HEATED FIBER, FABRIC, OR TEXTILE FOR HEATED APPAREL

(71) Applicant: University of Massachusetts, Boston, MA (US)

(72) Inventors: Trisha L. Andrew, Amherst, MA (US); Lushuai Zhang, Sunderland, MA (US); Morgan Baima, Sunderland, MA (US)

(73) Assignee: University of Massachusetts, Boston, MA (US)

( * ) Notice: Subject to any disclaimer, the term of this patent is extended or adjusted under 35 U.S.C. 154(b) by 337 days.

(21) Appl. No.: 16/258,165

(22) Filed: Jan. 25, 2019

(65) Prior Publication Data

US 2019/0230745 A1 Jul. 25, 2019

Related U.S. Application Data

(60) Provisional application No. 62/621,887, filed on Jan. 25, 2018.

(51) Int. Cl.

| | |
|---|---|
| ***H05B 3/34*** | (2006.01) |
| ***A41D 19/015*** | (2006.01) |
| ***H05B 3/14*** | (2006.01) |

(52) U.S. Cl.

CPC ..... *H05B 3/347* (2013.01); *A41D 19/01535* (2013.01); *H05B 3/146* (2013.01); *H05B 2203/011* (2013.01); *H05B 2203/013* (2013.01); *H05B 2203/036* (2013.01)

(58) Field of Classification Search

CPC ..... H05B 3/347; H05B 3/342; H05B 3/345; H05B 3/146; H05B 2203/011; H05B 2203/013; H05B 2203/036; H05B 2203/017; H05B 2214/02; A41D 19/01595; A41D 13/0051; A41D 19/01535

See application file for complete search history.

(56) References Cited

U.S. PATENT DOCUMENTS

| | | | | |
|---|---|---|---|---|
| 4,764,665 | A | 8/1988 | Orban et al. | |
| 6,229,123 | B1 * | 5/2001 | Kochman | A41D 13/0051 219/529 |
| 2018/0279416 | A1 * | 9/2018 | Sajic | H05B 3/03 |

OTHER PUBLICATIONS

Atanasov, Sarah E., "Highly Conductive and Conformal Poly(3,4-ethylenedioxythiophene) (PEDOT) Thin Films via Oxidative Molecular Layer Deposition", American Chemical Society, Chemistry of Materials, (2014), 3471-3478.

(Continued)

*Primary Examiner* — Shawntina T Fuqua

(74) *Attorney, Agent, or Firm* — Schwegman Lundberg & Woessner, P.A.

(57) ABSTRACT

A heating element composite comprises a substrate of one or more fibers or threads and an electrically-conductive polymer coating comprising an electrically-conductive polymer material deposited onto the one or more fibers or threads. A thickness of the electrically-conductive polymer coating is at least about 100 nanometers and the electrically-conductive polymer coating covers at least about 75% of an external surface area of the one or more fibers or threads of the substrate. The resulting heating element composite has a sheet resistance of from about 2 Ω/□ to about 200 Ω/□.

19 Claims, 18 Drawing Sheets
(17 of 18 Drawing Sheet(s) Filed in Color)

(56) References Cited

OTHER PUBLICATIONS

Bashir, Tariq, et al., "Production of highly conductive textile viscose yarns by chemical vapor deposition technique: a route to continuous process", John Wiley & Sons, Ltd., Polymers for advanced technologies, (2010), 2214-2221.
Cheng, Nongyi, et al., "Vapor phase organic chemistry to deposit conjugated polymer films on arbitrary substrates". Journal of Materials Chemistry C 5, (2017), 5787-5.
Cheng, Yin, et al., "Highly Stretchable and Conductive Copper Nanowire Based Fibers with Hierarchical Structure for Wearable Heaters", American Chemical Society, (2016), 32925-32933.
Ding, Yujie, et al., "Conductivity Trends of PEDOT-PSS Impregnated Fabric and the Effect of Conductivity on Electrochromic Textile", American Chemical Society, (2010), 1588-1593.
Doganay, Doga, et al., "Silver nanowire decorated heatable textiles", IOP Publishing, (2016), 8 pgs.
Guo, Yinben, et al., "Fluoroalkylsilane-Modified Textile-Based Personal Energy Management Device for Multifunctional Wearable Applications". American Chemical Society, Applied Materials & Interfaces, (2016), 4676-4683.
Gupta, Rita, et al., "Visibly Transparent Heaters", Applied Materials & Interfaces, (2016), 12559-12575.
Hsu, Po-Chun, et al., "Personal Thermal Management by Metallic Nanowire-Coated Textile", American Chemical Society, Nano Letters, (2014), 365-371.
Im, Sung Gap, et al., "Systematic Control of the Electrical Conductivity of Poly(3,4-ethylenedioxythiophene) via Oxidative Chemical Vapor Deposition", American Chemical Society, (2007), 6552-6556.
Jo, Hong Seok, et al., "Highly flexible, stretchable, patternable, transparent copper fiber heater on a complex 3D surface", NPG Asia Materials, (2017), 1-7 pgs.
Laforgue, Alexis, et al., "Electrically controlled colour-changing textiles using the resistive heating properties of PEDOT nano fibers†". Journal of Materials Chemistry, Communication, (2010), 8233-8235.
Li, Weijia, et al., "Study of the in vitro cytotoxicity testing of medical devices(Review)", (2015), 617-620.
Liu, Peng, et al., "Carbon-Nanotube-Film Microheater on a Polyethylene Terephthalate Substrate and its Application in Thermochromic Displays", Cummunications, (2011), 732-736.
Moraes, Maria R., et al., "Glycerol/PEDOT:PSS coated woven fabric as a flexible heating element on textiles†". Royal Society of Chemistry, Journal of Materials Chemistry C, (2017), 3807-3822.
Opwis, Klaus, et al., "Oxidative in situ deposition of conductive PEDOT:PTSA on textile substrates and their application as textile heating element", Elsevier B.V., (2012), 1912-1918.
Ryan, Jason D., et al., "Machine-Washable PEDOT:PSS Dyed Silk Yarns for Electronic Textiles", American Chemical Society, (2017), 9045-9050.
Yeon, C., et al., "Highly conductive PEDOT:PSS treated by sodium dodecyl sulfate for stretchable fabric heateis†", Royal Society of Chemistry, RSC Advances, (2017), 5888-5897.
Yoon, Yeo-Hwan, et al., "Transparent Film Heater Using Single-Walled Carbon Nanotubes", Advanced Materials, 19, (2007), 4284-4287.
Yu, Ziya, et al.,"Cotton modified with silver-nanowires/ polydopamine for a wearable thermal management device", RSC Advances, (2016), 67771-67777.
Zhang, Lushuai, et al., "Rugged Textile Electrodes for Wearable Devices Obtained by Vapor Coating Off-the-Shelf, Plain-Woven Fabrics", Advanced Functional Materials 1700415, [Online], Retrieved from the Internet: <URL: www.afm-journal.de, (2017), 9 pgs.
Zhang, Lushuai, et al., "Transforming Commercial Textiles and Threads into Sewable and Weavable Electric Heaters", Applied Materials & Interfaces, [Online], Retrieved from the Internet: <URL: www.acsami.org, (Aug. 30, 2017), 9 pgs.
Zhou, Jian, et al., "High-ampacity conductive polymer microfibers as fast response wearable heaters and electromechanical actuators", Royal Society of Chemistry, Journal of Materials Chemistry C, (2016), 1238-1249.

* cited by examiner

12B

12A

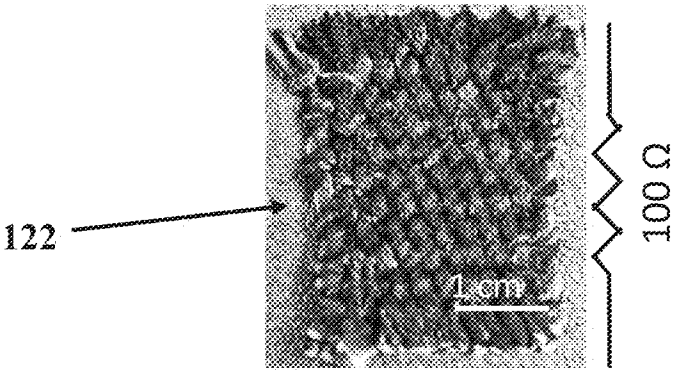
FIG. 10
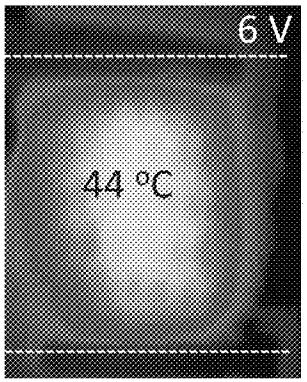
FIG. 11A
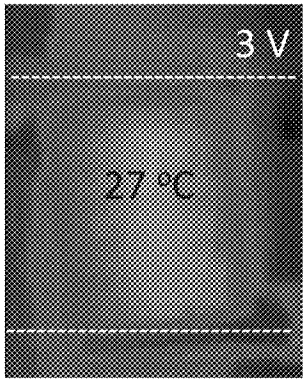
FIG. 11B
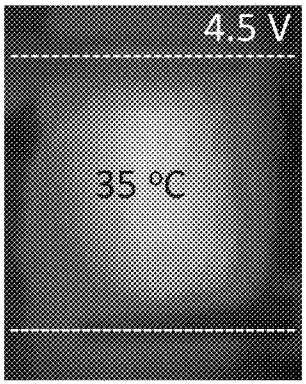
FIG. 11C
FIG. 11D

ELECTRICALLY-HEATED FIBER, FABRIC, OR TEXTILE FOR HEATED APPAREL

PRIORITY APPLICATION

This application claims priority to U.S. Provisional Application Ser. No. 62/621,887, filed Jan. 25, 2018, the disclosure of which is incorporated herein in its entirety by reference.

BACKGROUND

Temperature management of one or more parts of the body is a subject of interest for personal comfort, as well as for medical or veterinary heat therapy, such as for joint pain relief or for injury rehabilitation (including athletic rehabilitation). Electrical heaters are also ubiquitous in indoor and automobile climate control systems and portable temporary shelters.

Typical electrical heaters use the concept of joule heating (also referred to as "resistive heating" or "ohmic heating") in one or more heating elements. In Joule heating heat is generated when a voltage is applied across the heating element, where inelastic collisions between accelerated electrons and phonons occur as a current passes through a conductive material that forms the heating element. Contemporary commercially-available products have almost-exclusively used copper wires as the Joule heating element or elements. While copper-wire heating elements and the electrical heaters made from them are cheap and widely-available, electrical heaters including copper-wire heating elements are typically heavy and inflexible. Also, copper-wire heating elements cannot be cut, sewn, ironed, or woven like standard threads, such that copper-wire heating elements are not feasible for use in fashioning heated apparel.

SUMMARY

The present disclosure describes methods to modify conventional textiles (e.g., fabric, cloth, and the like) or fibers (e.g., threading yarns, and the like) into an electrically-heatable composite material, as well as the electrically-heatable composite material made by such a process. The electrically-heatable composite materials described herein can be fashioned into a fabric or threading heater (such as by cutting and sewing a fabric heater, or weaving or sewing with a threading heater) to fashion lightweight fabric-based heaters for local climate control and/or personal thermal management.

In an example, described herein, a method includes coating a textile-based or fiber-based substrate with an electrically-conducting polymer coating comprising an electrically-conducting polymeric material. The electrically-conducting polymeric material is coated onto the textile-based or fiber-based substrate via reactive vapor deposition under specified conditions that produce an electrically-conducting polymer coating having a specified thickness and that covers a specified portion of one or more fibers or threads of the textile-based or fiber-based substrate. In some examples, the reactive vapor deposition conditions are such that the electrically-conducting polymer coating substantially conformally coats one or more of the fibers or threads of the textile-based or fiber-based substrate.

The present inventors have recognized, among other things, that a problem to be solved can include textile-based or fiber-based electrode structures having an electrical resistance that is too high for practical application because it would require a voltage input for significant heating that is higher than may be practical for a transportable or wearable article. The present subject matter described herein can provide a solution to this problem, such as by providing for an electrically-conducting polymer coating having sufficient thickness or that coats a sufficient portion of each of the one or more fibers or threads of the textile-based or fiber-based substrate, or both. The present inventors have discovered that having an electrically-conductive polymer coating that is at least 100 nanometers (nm) thick, or that coats at least about 75% of a surface area of the fibers or threads of the substrate, or both, is particularly effective for use as a portable and/or wearable fabric-based or textile-based heating element.

In some examples, a fabric-based or textile-based heating element structure includes an electrically-conductive polymer coating that is at least 1 micrometer (μm) thick, and in some examples is 1.5 μm thick or thicker. In some examples, a fabric-based or textile-based heating element structure includes an electrically-conductive polymer coating that covers at least about 80% of the surface area of the fibers or threads that forms the substrate of the heating element, for example at least about 90% of the surface area, such as at least about 95% of the surface area, for example at least about 99% of the surface area, and in some examples all (100%) or substantially all (e.g., 99.9% or more) of the surface area of the fibers or threads that form the substrate of the heating element.

This summary is intended to provide an overview of subject matter of the present disclosure. It is not intended to provide an exclusive or exhaustive explanation of the invention. The detailed description is included to provide further information about the present disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

FIG. 10 is a fabric-based heating element formed by weaving a plurality of the coated cotton yarn threads from FIG. 5 into a woven textile sheet.

FIGS. 11A-11D are thermal-camera images of the woven textile sheet of FIG. 10 under different applied voltages.

DETAILED DESCRIPTION

Figure 1:
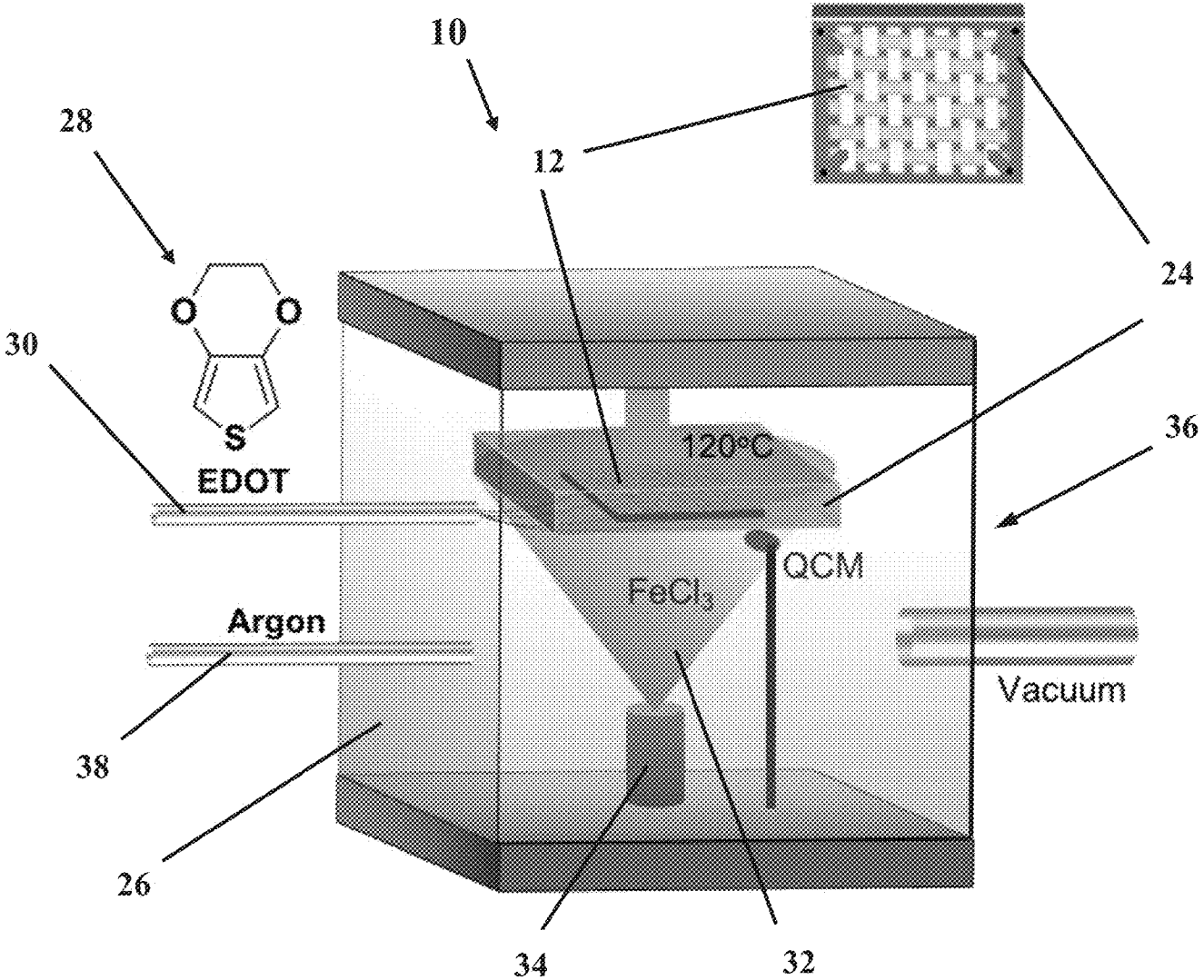
FIG. 1 is a conceptual schematic view of an example apparatus for reactive vapor deposition of an electrically-conductive polymer onto a textile-based substrate in order to convert the textile-based substrate into a textile-based electrically-conductive heating element.

The following detailed description is provided to describe, by way of illustration, specific embodiments of methods of depositing a coating of an electrically-conductive polymer material onto a textile-based or fiber-based substrate to produce a fiber or textile-based electrically conductive heating element. The following detailed description further describes examples of the resulting textile-based electrically conductive heating elements. The detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The example embodiments may be combined, other embodiments may be utilized, or structural, and logical changes may be made without departing from the scope of the present invention. While the disclosed subject matter will be described in conjunction with the enumerated claims, it will be understood that the exemplified subject matter is not intended to limit the claims to the disclosed subject matter. The following detailed description is, therefore, not to be taken in a limiting sense, and the scope of the present invention is defined by the appended claims and their equivalents.

References in the specification to "one embodiment", "an embodiment," "an example embodiment," etc., indicate that the embodiment described can include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" should be interpreted to include not only the explicitly recited values of about 0.1 wt. % to about 5 wt. %, but also the individual values (e.g., 1%, 2%, 3%, and 4%) and the sub-ranges (e.g., 0.1% to to 0.5%, 1.1% to 2.2%, and 3.3% to 4.4%) within the indicated range.

The term "about" as used herein can allow for a degree of variability in a value or range, for example, within 10%, within 5%, within 1%, within 0.5%, within 0.1% within 0.05%, within 0.01%, within 0.005%, or within 0.001% of a stated value or of a stated limit of a range, and includes the exact stated value or range.

The term "substantially" as used herein refers to a majority of, or mostly, such as at least about 50%, 60%, 70%, 80%, 90%, 95%, 96%, 97%, 98%, 99%, 99.5%, 99.9%, 99.99%, or at least about 99.999% or more, or 100%.

In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. The statement "about X to Y" has the same meaning as "about X to about Y,"" unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. Unless indicated otherwise, the statement "at least one of" when referring to a listed group is used to mean one or any combination of two or more of the members of the group. For example, the statement "at least one of A, B, and C" can have the same meaning as "A; B; C; A and B; A and C; B and C; or A, B, and C," or the statement "at least one of D, E, F, and G" can have the same meaning as "D; E; F; G; D and E; D and F; D and G; E and F; E and G: F and G; D, E, and F; D, E, and G; D, F, and G; E, F, and G; or D, E, F, and G." A comma can be used as a delimiter or digit group separator to the left or right of a decimal mark; for example, "0.000,1"" is equivalent to "0.0001."

In methods described herein, the acts can be carried out in any order without departing from the principles of the disclosed method, except when a temporal or operational sequence is explicitly recited. Furthermore, specified acts can be carried out concurrently unless explicit language recites that they be carried out separately. For example, a recited act of doing X and a recited act of doing Y can be conducted simultaneously within a single operation, and the resulting process will fall within the literal scope of the process. Recitation in a claim to the effect that first a step is performed, then several other steps are subsequently performed, shall be taken to mean that the first step is performed before any of the other steps, but the other steps can be performed in any suitable sequence, unless a sequence is further recited within the other steps. For example, claim elements that recite "Step A, Step B, Step C, Step D, and Step E" shall be construed to mean step A is carried out first and steps B, C, D, and E can be carried out in any sequence between steps A and E, and that the sequence still falls within the literal scope of the claimed process. A given step or sub-set of steps may also be repeated. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

It is to be understood that the phraseology or terminology employed herein, and not otherwise defined, is for the purpose of description only and not of limitation. Any use of section headings is intended to aid reading of the document and is not to be interpreted as limiting, and information that is relevant to a section heading may occur within or outside of that particular section. All publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

All publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

FABRICATION OF TEXTILE-BASED HEATING ELEMENT

As noted above, the present disclosure describes systems and method of producing fiber or textile-based electrically conductive heating elements (referred to hereinafter simply as "textile heating elements" for brevity). As described in more detail below, one or more of the resulting textile heating elements can be used to produce a wearable garment or other apparel (e.g., a joint brace) with the one or more textile heating elements integrated therein, which can provide for local heating of a specific part of the wearer's body. Lightweight, breathable and body-conformable electrical heaters have the potential to change traditional approaches to personal thermal management, medical heat therapy, joint pain relief, and athletic rehabilitation.

An absence of seamless and imperceptible integration into every day objects and garments has, thus far, relegated electrical heaters to a category of special-purpose electronics. For wearable devices to be broadly adopted, issues of comfort, aesthetics, haptic perception, and weight may require addressing. The systems and methods described herein provide for the fabrication of textile heating elements that can be easily and inconspicuously incorporated into every day objects and garments.

To replace conventional-but-cumbersome copper wires, designer fibers that include nanocarbon materials, fabric mimics made of conductive nanowires or meshes, or conducting polymer-impregnated cloths have been attempted as alternative Joule heating elements. While many of these designer fabrics have shown excellent electrical properties, they have been unable to also comprehensively address issues such as breathability, hap tic perception, bare skin compatibility, stable conductivity under frequent mechanical deformation, and straightforward integration into demanding textile and garment manufacturing processes.

FIG. 1 shows a schematic diagram of an apparatus 10 that can provide for reactive vapor deposition of an electrically-conductive polymer material (also referred to simply as a "conductive polymer" for brevity) onto a fiber-based or textile-based substrate 12 (also referred to simply as a "fiber substrate 12," in the case of fiber or threading or as a "textile substrate 12" for sheet-like substrates 12). As used herein, the term "textile," when referring to the substrate 12 that is being coated with the conductive polymer and/or to the resulting textile heating element, refers to a structure comprising one or more fibrous structures, and in particular to threading or thread-like structures (such as yarns, threads, and the like), arranged to collectively form a bendable, sheet-like layer of cloth or cloth-like material (such as by weaving or otherwise combining the one or more fibrous structures into a cloth layer). "Textiles" commonly refers to materials that form the cloth layers of a garment or other apparel, although the present description is not limited merely to "textiles" that are typically used for garment or apparel fabrication. That being said, in some examples, the apparatus 10 of FIG. 1 and a method of using the apparatus 10 may be configured for use with a textile substrate 12 comprising a conventional, off-the-shelf woven or non-woven fabric, such as cotton or bast-fiber fabric.

Figure 2B:
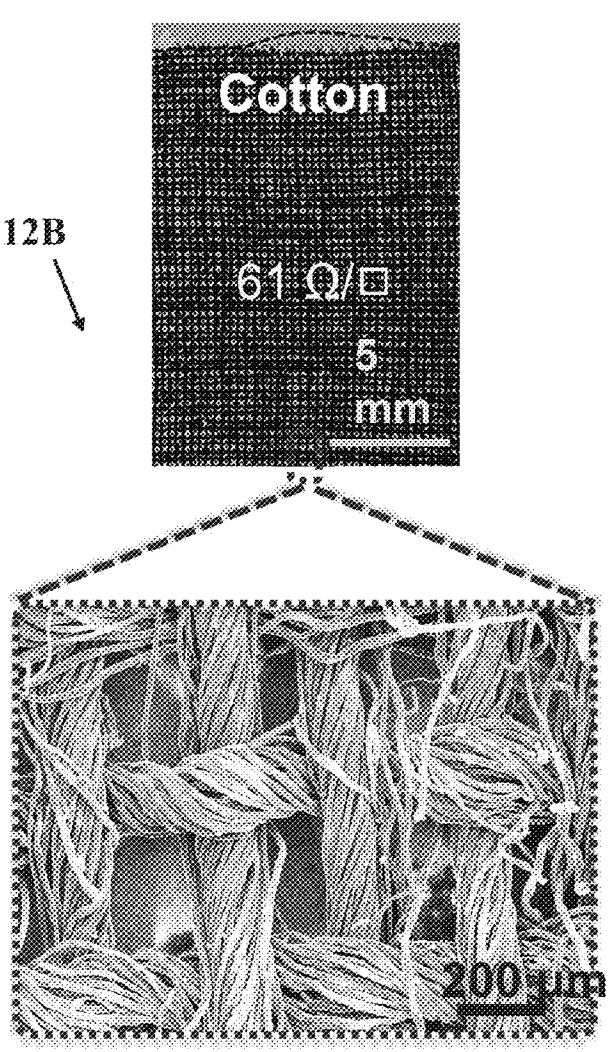
FIG. 2B is a scanning electron microgaph of a second example textile-based heating element made by coating a cotton fiber textile substrate with the electrically-conductive polymer (PEDOT) in the example apparatus of FIG. 1.
Figure 2A:
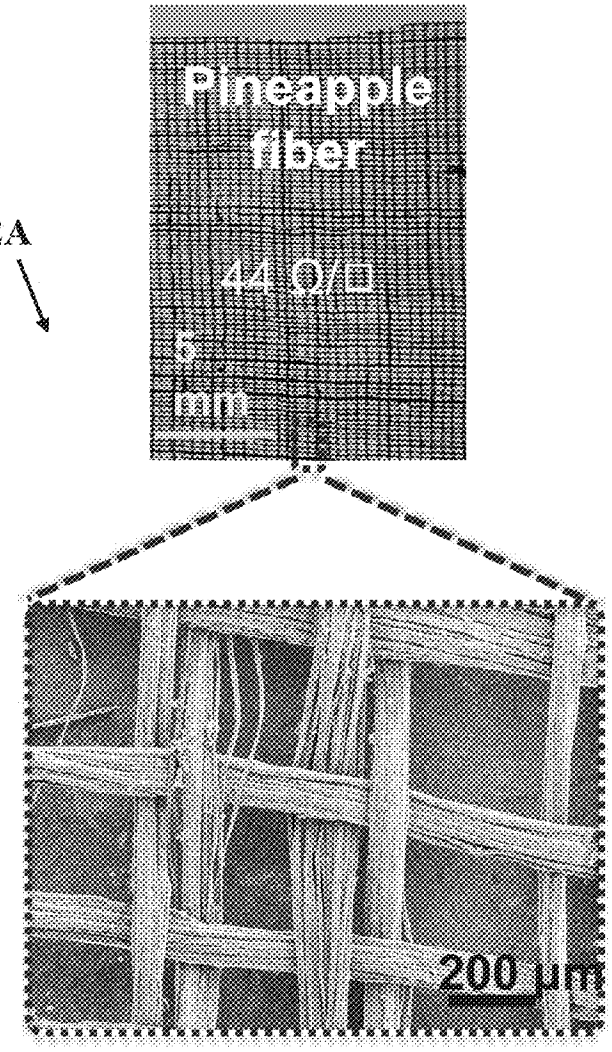
FIG. 2A is a scanning electron micrograph of a first example textile-based heating element made by coating a woven pineapple fiber textile substrate with the electrically-conductive polymer (PEDOT) in the example apparatus of FIG. 1.

FIGS. 2A and 2B show two specific examples of textile heating elements made by coating a fabric or textile material as the textile substrate 12 that is coated with the electrically-conductive polymer using the apparatus 10 of FIG. 1 to produce a textile-based heating element. FIG. 2A shows a first textile heating element comprising a textile substrate 12A made from a plurality of pineapple fiber threads coated with the conductive polymer. FIG. 2B shows a second example textile heating element comprising a textile substrate 12B made from a plurality of cotton fiber threads coated with the conductive polymer. Both the pineapple fiber substrate 12A of FIG. 2A and the cotton fiber substrate 12B of FIG. 2B are basic woven fabric sheets made of their respective fibers, although non-woven fabric sheets are also envisioned. The pineapple fiber and cotton fiber textile substrates 12A, 12B of FIGS. 2A and 2B (collectively referred to as "substrates 12") were selected because they are commercially-available textile materials that have been identified as being useful for the deposition of electrically-conductive polymer materials such as PEDOT. The pineapple and cotton substrates 12 were also chosen because they are lightweight, porous (i.e., breathable and amenable to air flow through the fabric) and are commonly used to create garments. The systems and methods described herein, as well as the resulting textile heating elements made therefrom, are not limited to these specific textile substrates 12 or to any particular commercially-available textile material.

Figure 3:
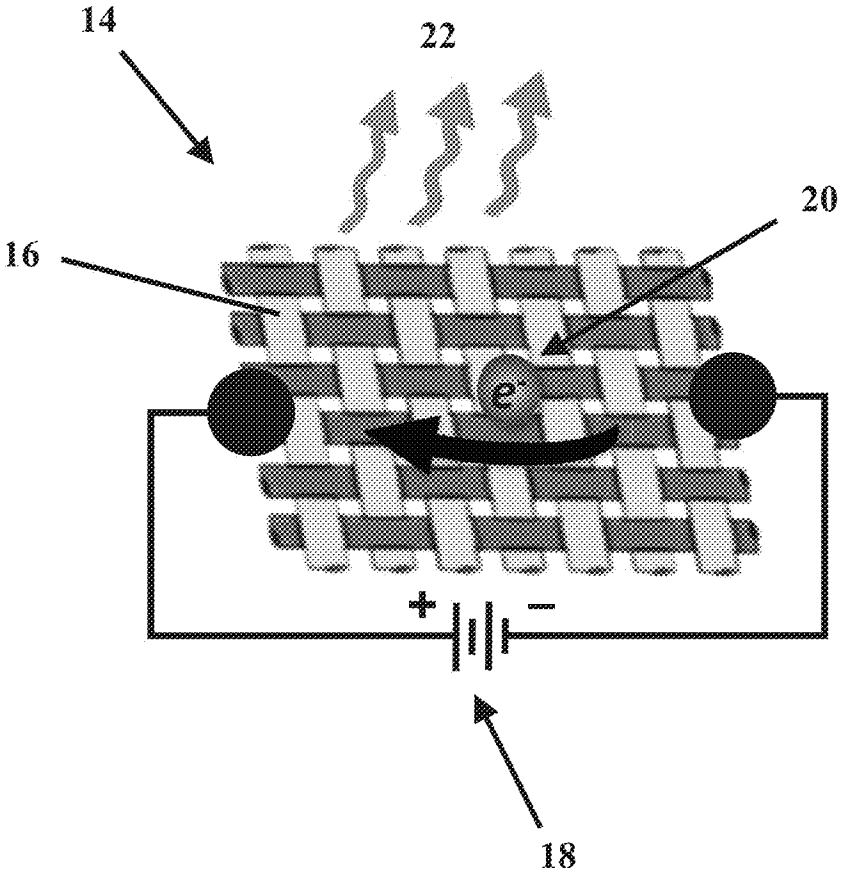
FIG. 3 is a conceptual view of the Joule heating effect that results from applying a voltage to any one of the example textile-based electrically-conductive heating elements described herein.

FIG. 3 shows a conceptual schematic diagram of an electronic heating device 14 that uses a textile-based heating element 16, such as a heating element produced by coating one of the textile substrates 12 shown in FIGS. 2A and 2B with an electrically-conductive polymer such as PEDOT. A voltage source 18, such as one or more batteries, are electrically coupled to the textile heating element 16, which generates a current 20 through the electrically-conductive polymer of the textile heating element 16. As the current 20 passes through the textile heating element 16, the temperature of the textile heating element 16 rises and is dissipated from the textile heating element 16 in the form of heat 22. The heat 22 can then be transferred to a specified location, e.g., via conduction from the textile heating element 16 to another structure in contact with the electronic heating device 14.

Returning to FIG. 1, the textile substrate 12 is coupled to a deposition stage 24, which is placed within a reactive vapor deposition chamber 26. One or more reactive precursor compounds 28 are fed into the chamber 26 via a precursor feed line 30, wherein the one or more reactive precursor compounds 28 react via in situ vapor phase polymerization to form an electrically-conductive polymer coating on the one or more fibers of the textile substrate 12. In an example, the reactive precursor compound 28 is 3,4-ethylenedioxythiophene ("EDOT") (as shown in FIG. 1), which polymerizes to form a poly(3,4-ethylenedioxythiophene) ("PEDOT") coating on the fibers or threads of the textile substrate 12. Other electrically-conductive materials may be used to form the conductive coating on a fiber or textile substrate 12 to form a fiber-based or textile-based heating element 16, so long as the material used to form the conductive coating can carry sufficient current density and do not substantially adversely affect the textile feel of the fiber or textile substrate 12.

The deposition chamber 26 is also configured to deliver an oxidant (e.g., $FeCl_3$), such as in the form of an oxidant vapor cloud 32. In an example, an oxidant heater 34 (e.g., a Luxel crucible heater) heats an oxidant feed to sublime or vaporize the oxidant to form the oxidant vapor cloud 32 which is then delivered to the deposition stage 24. In an example, the deposition stage 24 is positioned so that the textile substrate 12 is downward facing toward the oxidant heater 34 such that the oxidant vapor cloud 32 floats up to the textile substrate 12 on the deposition stage 24. The one or more reactive precursor compounds 28 (e.g., EDOT molecules) are delivered to the deposition stage 24 via a precursor feed line. The temperature of the deposition stage 24 and the textile substrate 12 are maintained at a specified deposition temperature, which can be from about 30° C. to about 200° C., such as about 120° C.

An in situ quartz crystal microbalance sensor 36 (also referred to herein as a "QCM sensor 36") can be included at or proximate to the deposition stage 24 to monitor flow rates of the one or more precursor compounds 28 and the oxidant to the deposition stage 24 and the thickness of the resulting conductive polymer coating film on the textile substrate 12 in real time. A flow controller (not shown in FIG. 1), such as a needle valve can be included on the precursor feed line to control the flow rate of the one or more precursor compounds 28 into the deposition chamber 26 via the precursor feed line. In an example, the flow rate of the one or more precursor compounds 28 into the deposition chamber 26 is controlled to be a relatively low rate so that the precursor vapor introduced into the deposition chamber 26 via the precursor feed line does not immediately condense. Under this feed flow rate constraint, the oxidant (e.g., $FeCl_3$) can be the limiting reagent for the polymerization of the reactive vapor deposition rather than the precursor compound 28 (EDOT). The feed rate of the oxidant vapor 32 to the deposition stage 24 can be controlled by adjusting the temperature of the oxidant heater 34. In an example, the temperature of the oxidant heater 34 can be correlated to the resulting film growth rate of the conductive polymer on the textile substrate 12. In an example, the temperature of the oxidant heater 34 was selected to provide for a specified film growth rate of about 10 angstroms per second (Å/s). An inert gas (e.g., one or more noble gases such as argon) can also be fed to the deposition chamber 26 via a second gas inlet 38. In an example, the second gas inlet 38 (e.g., argon feed 38)

is used, along with the feed rate of the one or more precursor compounds 28 (e.g., EDOT feed rate) and of the oxidant 32 (e.g., the $FeCl_3$ feed rate) to tune the pressure inside the deposition chamber 26 to a specified deposition pressure.

Further details regarding, example systems and example methods of depositing EDOT as a PEDOT conductive polymer coating on textile substrates are provided in Zhang et al., "Transforming Commercial Textiles and Threads into Sewable and Weavable Electric Heaters," ACS Applied Materials & Interfaces, p. 32299, published on Aug. 30, 2017, DOI 10.1021./acsami.7b10514; in Zhang et al., "Rugged Textile Electrodes for Wearable Devices Obtained by Vapor Coating Off-the-Shelf, Plain-Woven Fabrics," Advanced Functional Materials, p. 1700415, published on May 2, 2017, DOI 10.1002/adfm.201700415; and in Nongyi et al., "Vapor phase organic chemistry to deposit conjugated polymer films on arbitrary substrates," Journal of Materials Chemistry C, p. 5787, published on Aug. 30, 2017, DOI 10.1039/c7tc00293a; Nen.

DEPOSITION CHAMBER PRESSURE

A parameter that can be of particular importance for electric heaters that use conductive Joule heating elements is the amount of electrical power required to heat the heating element to an acceptable and effective heating temperature. This is particularly true for heating devices that are intended to be portable—an importance that can be even more pronounced for wearable portable heating structures because of limitations on battery life and electrical power delivery for a device that is to be worn close to a person's or animal's body. In order to achieve an electrical heater that consumes low power (e.g., the wattage that can be delivered at a voltage of from about 1 V to about 3 V, with an upper limit of about 120 V, at a desired heating temperature), it is desirable to use a heating element that, overall, is highly conductive, e.g., a heating element with a relatively low resistance to electrical current. For the present disclosure, the concept of sheet resistance is being used to analyze the overall resistivity of the textile heating elements produced by the systems and methods described herein. As used herein, the term "sheet resistance" refers to a measure of the electrical resistance of thin film or layer of material that has a uniform or substantially uniform thickness (as is typically the case with the coating of a conductive polymer that is coated via reactive chemical vapor deposition, like the example of PEDOT described above). "Sheet resistance" can be defined as the resistivity of the material per unit of thickness of the material (e.g., $R_s=\rho/t$, where Rs is the sheet resistance, ρ is the resistivity, and t is the thickness of the material). Resistivity (ρ) is measured in SI units of ohm-meters (Ω⊕m), while the thickness (t) is measured in SI units of meters (m), so that Rs=ρ/t would have SI units of ohms (Ω). However, in order to avoid confusion with the overall electrical resistance (which also is measured in SI units of Ω), sheet resistance is referred to in units of "ohms per square," which is denoted herein as "Ω/□."

Previously reported structures that included. PEDOT films on substrates were found to have sheet resistances that were greater than 200 Ω/□, which the inventors have found was typically too high for a desirable minimum voltage input (e.g., around 5 V) that can affect noticeable Joule heating in these electrodes. As discussed in more detail below, the inventors have determined more optimal processing parameters for the system and method of coating fiber-based or textile-based substrates with a conducting polymer film via reactive vapor deposition. Prior reported studies on the reactive vapor deposition of PEDOT identified the temperature of the substrate stage as a parameter that affected the conductivity of resulting conductive polymer films. In those studies, a stage temperature of 120° C. was found to produce the highest conductivity for PEDOT films produced on glass substrates. However, the inventors found that sheet resistances textile heating elements only decreased nominally between a heating element with a PEDOT coating deposited with a stage temperature of 80° C. compared to a heating element with PEDOT deposited onto a stage with a temperature of 120° C.

Rather, the inventors have found that the selected deposition pressure within the deposition chamber 26 can have a significant impact on the resulting film of the conductive polymer (e.g., PEDOT) that is formed on the textile substrate 12. For example, TABLE 1 below lists the lateral resistance measured across a one (1) inch length (about 2.5 centimeters (cm)) for PEDOT films having a thickness of about 100 nanometers (nm) that were deposited on a woven pineapple fiber textile substrate 12A (shown in FIG. 2A) and on a cotton fiber textile substrate 12B (shown in FIG. 2B) with deposition chamber pressures of 100 milliTorr (mTorr), 300 mTorr, and 500 mTorr.

TABLE 1

Lateral resistances of textile vapor coated with a 100 nm thick PEDOT film at varying chamber pressures.

| | 100 mTorr | 300 mTorr | 500 mTorr |
|---|---|---|---|
| Pineapple fiber | 73 kΩ | 11 kΩ | 2 kΩ |
| Cotton | 195 kΩ | 50 kΩ | 18 kΩ |

As shown in TABLE 1, a seven (7) fold decrease in the lateral resistance (e.g., from 73 kiloohms (kΩ) to 11 kΩ) was observed for the pineapple fiber textile substrate 12A when the PEDOT film was coated at a chamber pressure of 300 mTorr compared to a corresponding pineapple fiber substrate 12A where the PEDOT was deposited in a 100 mTorr chamber. A further five (5) fold decrease in the lateral resistance (e.g., from 11 kΩ to 2 kΩ) was observed when the chamber pressure during deposition of the PEDOT onto the pineapple fiber substrate 12A was increased to 500 mTorr. Similar reduction in lateral resistance was also observed for PEDOT-coated cotton fiber substrates 12B (e.g., an almost four (4) fold decrease in lateral resistance between a 100 mTorr and a 300 mTorr deposition pressure (e.g., from 195 kΩ to 50 kΩ) and an almost three (3) fold decrease between 300 mTorr and 500 mTorr chamber pressures (e.g., from 50 kΩ to 18 kΩ)).

In some examples, the deposition pressure in the chamber 26 is tuned to a specified pressure that is at least about 100 mTorr, such as at least about 200 mTorr, for example at least about 250 mTorr, such as at least about 300 mTorr, for example at least about 400 mTorr, such as at least about 500 mTorr. A pressure of about 100 mTorr or more was found to be beneficial to provide for a coating of the conductive polymer that is thick enough and that covers a sufficient potion of each fiber (e.g., a substantial portion of a circumference of each fiber) to provide for good electrical conductivity and that has an overall sheet resistance that is low enough to provide for good Joule heating at an acceptable voltage input requirement for efficient heating. In some examples, a chamber pressure of about 200 mTorr or more, such as about 250 mTorr or more, and in particular about 300 mTorr or more were found to be particularly beneficial for more complete coverage of the fibers or threading of the textile substrate with a coating of the conductive polymer that is of sufficient thickness. In some examples, it was found that while higher deposition pressures (e.g., at or proximate to 500 mTorr or greater) yielded textile electrodes with the highest conductivities (e.g., the lowest resistance), the higher pressure could tend to cause the $FeCl_3$ oxidant to diffuse into and clog the precursor feed. Therefore, in some examples, a chamber pressure of 300 mTorr or less was chosen to maintain chamber longevity.

In some examples, the systems and methods described herein, e.g., with the relatively high pressure in the deposition chamber 26, are able to produce a final textile heating element with a sheet resistance that is from about 2 Ω/□ to about 200 Ω/□, such as from about 25 Ω/□ to about 150 Ω/□, for example from about 40 Ω/□ to about 100 Ω/□. As noted above, when the sheet resistance is too high (e.g., greater than 200 Ω/□), than the voltage and power requirements tend to be too high for a wearable device with currently-existing battery and portable power supply technology. Conversely, if the sheet resistance is too low (e.g., less than 2 Ω/□), then the textile heating element will not experience sufficient heating when current is supplied to the textile heating element, at least not current from currently-existing battery and power supply technology that can be used in a portable or wearable device. In some examples, the systems and methods described herein produce a textile heating element with a sheet resistance of about 200 Ω/□ or less, for example any one of about 190 Ω/□ or less, about 185 Ω/□ or less, about 180 Ω/□ or less, about 175 Ω/□ or less, about 170 Ω/□ or less, about 165 Ω/□ or less, about 160 Ω/□ or less, about 155 Ω/□ or less, about 150 Ω/□ or less, about 145 Ω/□ or less, about 140 Ω/□ or less, about 135 Ω/□ or less, about 130 Ω/□ or less, about 125 Ω/□ or less, about 120 Ω/□ or less, about 115 Ω/□ or less, about 110 Ω/□ or less, about 105 Ω/□ or less, about 100 Ω/□ or less, about 95 Ω/□ or less, about 90 Ω/□ or less, about 85 Ω/□ or less, about 80 Ω/□ or less, about 75 Ω/□ or less, about 70 Ω/□ or less, about 65 Ω/□ or less, about 60 Ω/□ or less, about 55 Ω/□ or less, about 50 Ω/□ or less, about 45 Ω/□ or less, about 40 Ω/□ or less, about 35 Ω/□ or less, about 30 Ω/□ or less, or about 25 Ω/□ or less.

The inventors have found that the higher chamber pressure described above results in a significantly thicker coating of the conductive polymer and more complete coverage of the of the fibers or threading that forms the textile substrate 12. For example, it was found that a relatively high pressure in the deposition chamber 26 (e.g., about 100 mTorr or more, such as about 200 mTorr or more, for example about 300 mTorr or more) can achieve a film thickness of the conductive polymer that is significantly more than would be expected compared to earlier reported reactive vapor deposited coatings at lower pressures.

The present inventors believe that a larger thickness for the layer of the conductive polymer that is deposited onto the fibers or threads of the textile substrate 12 can provide for a more efficient textile heating element 14 because the thicker coating can carry a higher current density along the coated fibers or threads. In some examples, the system of FIG. 1 or the method that it practices is capable of producing a final textile heating element 14 with a coating of conductive polymer (e.g., PEDOT) that is at least about 100 nanometers (nm) thick, such as at least about 250 nm thick, for example at least about 500 nm thick, such as at least about 600 nm, at least about 650 nm, at least about 700 nm, at least about 750 nm, at least about 800 nm, at least about 850 nm, at least about 900 nm, at least about 950 nm, at least about 1 micrometer (μm), at least about 1.1 μm, at least about 1.2 μm, at least about 1.25 μm, at least about 1.3 μm, at least about 1.4 μm, at least about 1.5 μm, at least about 1.6 μm, at least about 1.7 μm, at least about 1.75 μm, at least about 1.8 μm, at least about 1.9 μm, at least about 2 μm, at least about 2.5 μm, at least about 3 μm, at least about 4 μm, or at least about 5 μm. The inventors have found that a thickness of at least about 1.5 μm for the conductive polymer can be particularly useful for the fabrication of a textile heating element 14 that is useful and efficient as a wearable, textile-based Joule heating element 14.

The inventors have found, however, that there is usually a practical limit to how thick the coating of the conductive polymer can be before gains in the potential current density are countered by undesirable properties of the resulting textile heating element 14. In particular, when the thickness of the conductive poly trier coating is too thick, the final textile heating element 14 can become undesirably inflexible, the textile heating element 14 can begin to lose the tactile feel of the underlying textile substrate (e.g., the final textile heating element 14 might feel unacceptably different compared to the underlying textile substrate), or the conductive polymer can begin to reduce breathability of the textile heating element 14 below that which is desired. In some examples, the thickness of the conductive polymer on the fibers or threads of the textile substrate are no more than about 10 μm, such as no more than about 9 μm, for example no more than about 8 μm, such as no more than about 7.5 μm, for example no more than about 7 μm, such as no more than about 6 μm, for example no more than about 5 μm, such as no more than about 4 μm, for example no more than about 3 μm, such as no more than about 2.5 μm, for example no more than about 2 μm. In some examples, the thickness of the conductive polymer coating on the fibers or threads of the textile substrate is from about 100 nm to about 10 μm, such as from about 250 nm to about 5 μm, for example from about 500 nm to about 2.5 μm, such as from about 1 μm to about 2 μm.

Regarding the more complete coverage of the fibers or threads of the textile substrate that was observed, without wishing to be bound by any particular theory, the inventors believe that the higher chamber pressure results in shorter reactant mean free paths for the one or more precursor compounds and the oxidant. It is believed that the shorter reactant mean free paths, in turn, produce more complete surface coverage on the fibrous microstructure of the fibers or threading that forms the textile substrate, in particular on rough and textured surfaces that are typical on textile-based substrates. It is further believed that this more complete coverage is due to a higher frequency of surface-restricted reactions occurring over a larger percentage of the surface area of the fibers or threads of the textile substrate (e.g., on both the front and back sides of the textile substrate and around a larger percentage of the circumference of individual threads and/or fibers of the textile substrate), due to improved transport of the reactive precursor or precursors and the oxidant to the surface of the fibers or threads (e.g., more complete diffusion or other transport, or reduced boundary layer formation, or both), and because of suppression of line-of-sight deposition events.

Figure 4A:
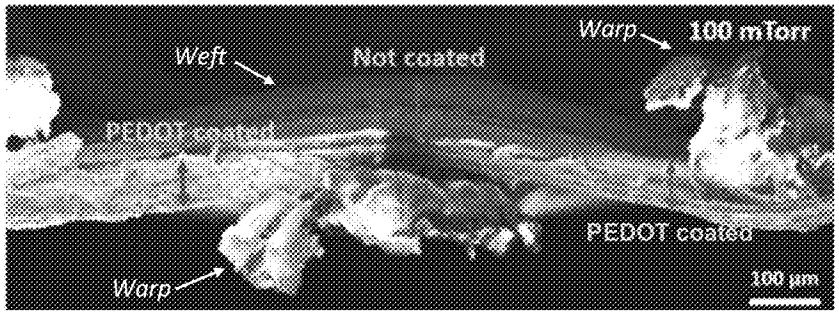
FIG. 4A is a scanning electron micrograph of a cross-section of a woven pineapple fiber substrate coated with a PEDOT film at a deposition chamber pressure of 100 mTorr.
Figure 4B:
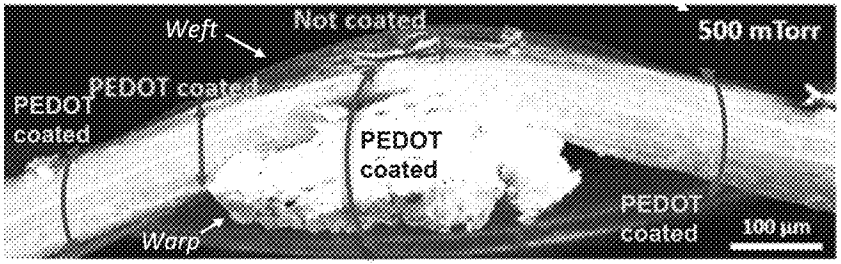
FIG. 4B is a scanning electron micrograph of a cross-section of a woven pineapple fiber substrate coated with a PEDOT film at a deposition chamber pressure of 500 mTorr.

To test the hypothesis that a higher chamber pressure leads to more thorough surface coverage (perhaps even at shallowly buried interfaces), scanning electron micrograph images of the warp-weft intersects of example PEDOT-coated pineapple fiber substrates were taken and examined for substrates that had been coated with a chamber pressure of 100 mTorr (FIG. 4A) and at 500 mTorr (FIG. 4B). At 100 mTorr, the warp and weft threads tended to act as each other's shadow masks for each other at the warp-weft interface. Therefore, little to no PEDOT coating was found in the buried interfaces where the warp thread crossed over the weft thread or vice versa (see FIG. 4A) because of inefficient diffusion of reactants. In contrast, for the substrate coated with a chamber pressure of 500 mTorr (FIG. 4B), the buried interfaces were coated with PEDOT. In fact, near 360° coverage of all the warp and weft threads of the plain-woven fabric substrate were observed when the vapor coating was performed at 500 mTorr.

In some examples, the apparatus 10 of FIG. 1 or the method that it practices is capable of producing a final textile heating element 14 wherein a relatively large portion of the surface area of the fibers or threads that make up the textile substrate. The present inventors believe that, in some examples, producing a final textile heating element 14 where at least about 75% of the total surface area of the fibers or threads that make up the textile substrate are coated with the conductive polymer (e.g., PEDOT) is particular useful for Joule heating applications, for example at least about 80% of the surface area (such as from about 80% to about 90%), for example at least about 90% of the surface area, such as at least about 95% of the surface area. In some examples, the electrically-conductive polymer coating that coats the textile substrate covers about 76% or more, about 77% or more, about 78% or more, about 79% or more, about 80% or more, about 81% or more, about 82% or more, about 83% or more, about 84% or more, about 85% or more, about 86% or more, about 87% or more, about 88% or more, about 89% or more, about 90% or more, about 91% or more, about 92% or more, about 93% or more, about 94% or more, about 95% or more, about 96% or more, about 97% or more, about 98% or more, about 99% or more, about 99.5% or more, about 99.6% or more, about 99.7% or more, about 99.8% or more, about 99.9% or more, or about 99.99% or more of the surface area of the fibers or threads that form the textile substrate.

Figure 5:
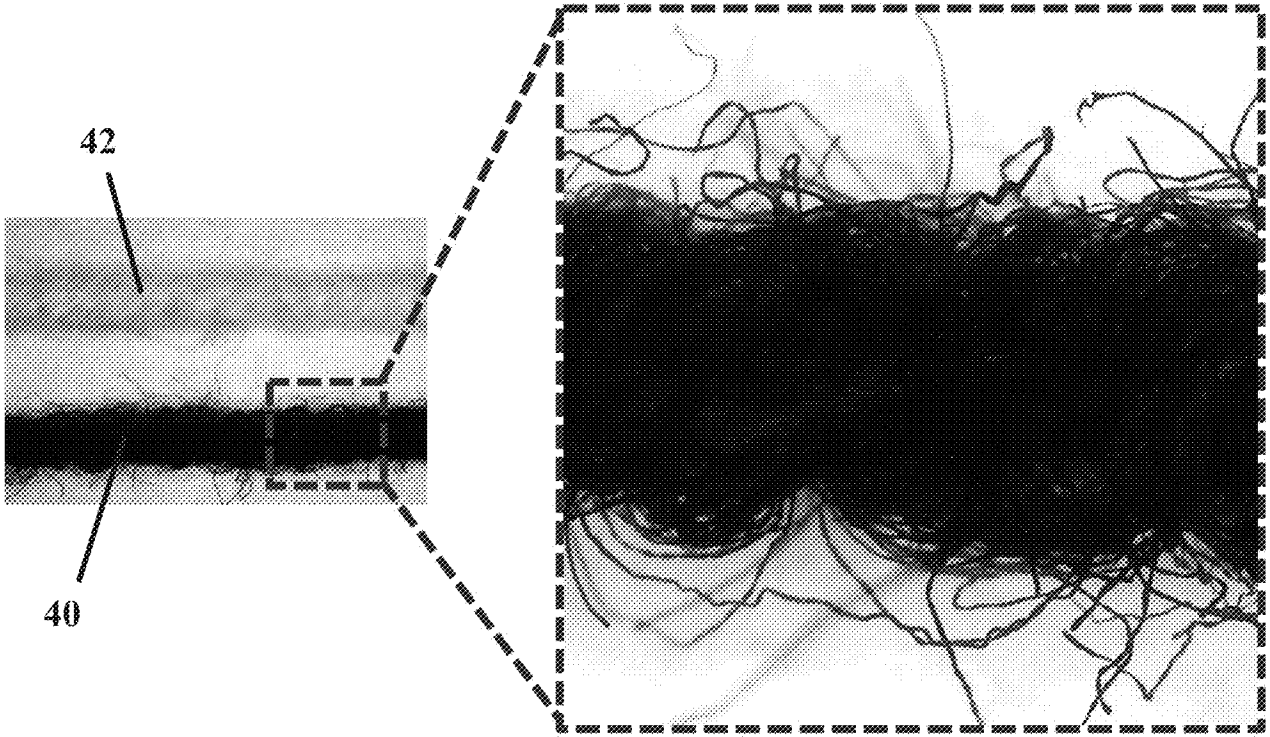
FIG. 5 show photographs of an uncoated cotton yarn thread (top) and the same cotton yarn thread after being coated with an electrically-conductive polymer coating in the example apparatus of FIG. 1 (bottom and close-up view).

In some examples, the system or method described above with respect to FIG. 1 is able to produce a coating of the conductive polymer that is highly conformal to the surfaces of the fibers or threads of the textile substrate. As used herein, the term "conformal," when referring to the coating by the conductive polymer, refers to the conductive polymer conforming or substantially conforming to the contours of the fibers or threads of the textile substrate, e.g., that the conductive polymer coating matches or substantially matches a contour of the outer surfaces of the fibers or threads of the textile substrate. FIG. 5 shows an example of substantially conformal coating of a cotton fiber yarn (e.g., that can be used to form a textile substrate) to provide a coated fiber strand 40. The top yarn strand 42 in FIG. 5 (labeled as "Pristine Cotton") is an example of the cotton fiber before being coated with a conductive polymer e.g., PEDOT) via vapor deposition. The bottom yarn strand 40 in FIG. 5 (labeled as "PEDOT-Coated Cotton"), and the enlarged view of that yarn strand, show that the PEDOT polymer substantially coats the yarn in such a way that the vapor-deposited PEDOT substantially conforms to the contour of the individual fiber morphology of the yarn strand 42, even on the microfibrous structures (sometimes referred to as microfibrils) of the cotton yarn 42.

The present inventors believe that greater coverage of the fibers or threads of the textile substrate 12 (e.g., with the percentage coverage described above, or with the conformal or substantially conformal coating of the fiber or textile substrate 12 with the conductive polymer, or both) provide for reduced sheet resistance of the resulting textile heating element 14 because the heating element 14 will have more places along each coated fiber or thread where electrical contact can be made between coated fibers or threads of the textile heating element 14, resulting in a greater number of potential electrical pathways for current to travel along when a voltage is applied to the textile heating element 14. It is also believed that more coverage of the surface area of the fibers or threads provides a greater area for current to travel along the coated fibers and, therefore, can support larger current densities along the length of individual coated fibers or threads.

High surface area coverage or conformal or substantially conformal coverage of the fibers or threads of the textile substrate 12, or both, can result in the conductive polymer coating having a minimal or even unnoticeable effect on the porosity and breathability of the final textile heating element 14 compared to that of the original textile substrate 12 (which was not found to be achievable by previously-reported conductive clothes formed by in situ solution polymerization). The high surface area coverage or the conformal or substantially conformal coverage of the fibers or threads, or both, can also result in the final coated textile heating element 14 feeling substantially the same on a wearer's skin as the wearer would feel with the uncoated textile substrate 12, which can be of great benefit to a designer of a piece of apparel that incorporates a textile heating element 14 according to the present description because the designer will be able to select fabrics for the apparel according to his or her existing knowledge of fabrics and according to the desired feel of the final piece of apparel. In other words, a designer will not have to be concerned with the coating process significantly altering the feel of the fabric, which can reduce over design production time because of a reduced need for trial and error of coated fabrics to be used as a textile heating element 14.

A high percentage of coverage and/or conformal or substantially conformal coating with the conductive polymer can also allow for the production of an effective textile heating element 14 with a relatively small increase in mass compared to an uncoated textile substrate 12, even for the relatively larger coating thicknesses that are achieved with the systems and methods described herein. In some examples the mass increase on the textile substrate 12 due to the deposition of the conductive polymer coating (e.g., the difference between the final mass of the textile heating element 14 and the initial mass of the uncoated textile substrate 12) can be 5% or less, such as 2% or less, for example 1% or less. In one specific example, a one (1) cm by one (1) cm square of the cotton fiber substrate 12B of FIG. 2B had a measured mass before coating of about 27.66 milligrams (mg). After coating with a 1.5 μm thick coating of PEDOT that was deposited at 300 mTorr (such that it substantially covered at least about 90% of the surface area of the substrate square), the same square of the cotton substrate 12B had a measured mass of about 27.83 mg, representing just a 0.6% increase in mass. Therefore, even with the coating of the fibers or threads of the textile substrate 12 with a relatively thick coating of the conductive polymer, the resulting textile heating element 14 will remain substantially the same weight as the original textile substrate 12, which can allow apparel or other articles that include a textile heating element 14 to remain relatively lightweight, or at least substantially the same weight as the underlying material or materials of the textile substrate 12.

The inventors also hypothesize that higher number-average molecular weights for the conductive polymer that coats the textile heating element 14 may be obtained at higher chamber pressures due to the increased frequency of oligomer-oligomer couplings compared to the predominance of oligomer-monomer or monomer-monomer interactions at lower chamber pressures. However, this hypothesis was difficult or impossible to prove experimentally because the PEDOT coatings made by the inventors have negligible solubility in most solvents such that accurate molecular weight distributions could not be measured using readily-available instrumentation. For example, a 1 cm×1 cm sample of a textile heating element 14 made from the cotton fiber textile substrate 12B of FIG. 2B, the measured mass before coating was about 27.664 mg. After coating with a 1.5 micron thick PEDOT film, the resulting textile heating element 14 had a mass of 27.829 mg or only about a 0.6% (about 0.165 mg) increase in mass.

POST-DESPOSITION PROCESSING

In some examples, after the reactive vapor deposition in the deposition chamber 26 of FIG. 1, the resulting textile heating element 14 can be washed to remove trapped oxidant or components thereof (such as trapped iron salts from an $FeCl_3$ oxidant) or unreacted precursor compound (e.g., EDOT). In an example, the washing can include applying one or more of an acid solution, a base solution, or an alcohol solution, selected to remove one or more specific compounds from the textile heating element 14. In an example, the washing includes applying an aqueous HCl acid solution to remove trapped iron salts from the textile heating element 14. In an example, the washing can include applying a methanol solution to remove one or both of residual precursor (e.g., EDOT monomer), or an acid solution that had been previously used to wash oxidant from the textile heating element 14 (e.g., to wash away residual HCl that had been added to remove iron salts). In some examples, the washed textile heating element 14 is dried or allowed to dry to ensure that residual water and other compounds in the washing solution have had a chance to volatize away from the textile heating element 14.

BIOCOMPATIBILITY

The examples of coated textile heating elements 14 described herein were found to be biocompatible, e.g., according to ISO 10993-5 standard guidelines. Samples of the example cotton substrate 12B of FIG. 2B coated with PEDOT according to the methods described above was tested with an Agar Overlay Test with L929 cells (mouse connective tissue) in triplicate by Nelson Laboratories (Utah, USA). The viability of cells grown on a thin Agar overlay placed over the PEDOT-coated samples were graded against a positive control (Latex beads, reactivity grade "4") and a negative control (poly(propylene) pellets, reactivity grade "0"). The observed average reactivity gale of the PEDOT-coated cotton was "0," qualifying the samples as safe for contact with human skin without expecting to cause adverse reactions due to chemical leaching.

HANDLING AND STABILITY

The polymer-coated textile heating elements 14 made by the reactive vapor deposition process and with the reactive vapor deposition system described above are sufficiently stable such that they can be handled or manipulated by one or more processes that can be performed on any other commercial fabric without substantially damaging the conductive polymer coating such that the textile heating element 14 can still be used for Joule heating. For example, a polymer-coated textile heating element 14 as described herein can be cut and/or sewn together with another polymer-coated textile heating element 14 according to the present invention without a substantial detriment to Joule heating performance of the sewn-together heating elements 14 compared to a comparably-sized and comparably-coated single textile heating element 14. In some examples, two or more separate textile heating elements 14 can be sewn together with no detrimental effect or with a negligible effect on the Joule heating performance compared to a single heating element 14. In some examples, two or more of the textile heating elements 14 described herein can be sewn with ordinary textile threading. In other words, in some examples, the threading that is used to sew the textile heating elements 14 together need not be a special electrically-conductive material.

Figure 6:
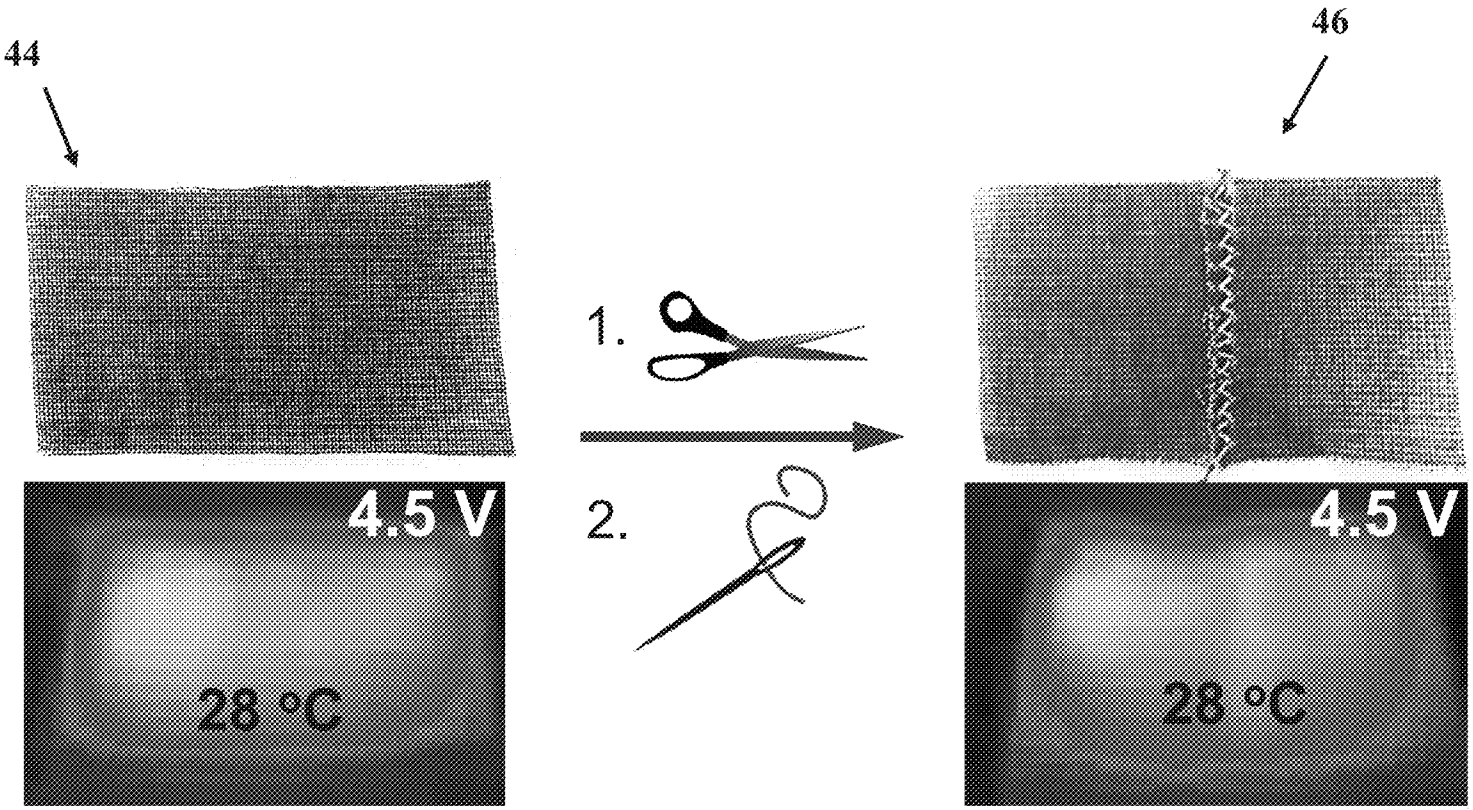
FIG. 6 includes optical and thermal images of an example textile-based electrically conductive heating element before and after cutting and sewing of the heating element.

FIG. 6 shows an example of a single swatch of a textile heating element 44 comprising a PEDOT-coated cotton fabric, which can be similar or identical to the heating elements 14 described above, that has been heated to 28° C. when the ambient temperature is 19° C. by applying voltage to the textile heating element using a 4.5 V alkaline battery. FIG. 6 also shows an example textile heating apparatus comprising the same single swatch of textile heating element after it has been cut into two separate sheets of the textile heating element composite (e.g., with a pair of textile shears) and sewn back together with a needle and ordinary (non-conductive coating) cotton thread to form a sewn heating element 46. A zig-zag pattern was used to sew the two pieces together so that the seam was obvious. As can be seen by the thermal images of FIG. 6, there was almost no difference in electrothermal response for the sewn heating element 46 compared to the original textile heating element 44. No hot spots or cool spots were observed to be generated along the seam. The sewn heating element 46 was also heated to the same or substantially the same temperature of 28° C., when the same 4.5 V alkaline battery was used to apply voltage to the textile heating composite.

The electrothermal stability or ruggedness of the conductive polymer-coated textile heating elements 14 described herein demonstrate that these textile heating elements 14 can be used to form customized garment-based heating elements using conventional textile cutting and textile sewing techniques. This allows the textile heating elements 14 described herein to he tailorable to any part of the body for which conventional textile articles are made, including but not limited to: hands (e.g., fingers or palm, or both), feet (e.g., toes or the main part of the foot), or joints (e.g., elbows, knees, hips, shoulders, angles, or other joint areas that might be treatable with heat therapy).

PROTECTIVE COATING

Examples of the textile heating elements 14 described above, e.g., a fiber-based or textile-based substrate 12 coated with an electrically-conductive polymer coating (such as PEDOT) that has been deposited via reactive vapor deposition, were found to maintain stable conductivities even after exposure to warm moisture (e.g., body heat and sweat). However, in some examples, the textile heating element can be further treated to electrically protect or separate the electrically conductive polymer of the heating element from its environment. In some examples, the additional treatment comprises applying a protective material onto the outer surface or surfaces of the conductive polymer of the textile heating element. In some examples, the protective coating completely or substantially completely covers all exposed surfaces of the conductive polymer, and in some examples completely or substantially completely covers all exposed surfaces of the textile heating element. In some examples, the protective coating comprises an electrically insulating material, such as a dielectric material, that electrically insulates the conductive polymer, for example by electrically isolating the heating element from structures or materials that may come into contact with the textile heating element. In some examples wherein one or more of the textile heating elements are part of a wearable or otherwise body-mounted electrical heating garment or other piece of apparel, the protective coating reduces the likelihood that a part of the wearer's body (e.g., the wearer's skin) will electrically contact the conductive polymer, which could potentially lead to the wearer experiencing an electrical shock.

In some examples, the protective coating can comprise one or more fluoroalkyl-based compounds, such as one or more fluoroalkylsiloxane compounds, which have been proposed for biocompatible dielectric coatings. In an example, a fluoroalkylsiloxane-based protective coating is produced by exposing the textile heating element to trichloro(1H,1H,2H,2H-perfluorooctyl) silane (PFOTS), e.g., after the conductive polymer had been deposited onto the fiber or textile substrate 12. In an example, the polymer-coated textile heating element is exposed to PFOTS vapor for a specified amount of time sufficient for the PFOTS to completely or substantially completely contact the exposed outer surfaces of the textile heating element. In an example, the specified amount of time is at least about 30 minutes). After the specified amount of time, the PFOTS-treated textile heating element is thermally annealed in the presence of methanol vapor at a specified temperature sufficient such that PFOTS vapor at the surface of the textile heating element forms a fluoroalkyl-based material on at least the exposed surfaces of the conductive polymer. In an example, the specified temperature is about 100° C.

The formation of the fluoroalkyl-based protective layer results in a packaged heating element, wherein the fluoroalkyl-based protective layer is resistant to humidity invasion onto or into the conductive polymer film (e.g., into or onto the PEDOT film) of the textile heating element. In one example textile heating element, formation of a fluoroalkyl-based coating was confirmed by placing the textile heating element in a water both before and after exposure to the PFOTS. The textile heating element sample that had yet to be exposed to the PFOTS sank into the water, exhibiting hydrophilic properties. After the exposure to PFOTS and heat annealing the textile heating element, the textile heating element floated on top of the surface of the water, demonstrating it had been changed into a hydrophobic body. Lateral resistances and total weight of the polymer-coated textile did not observably change after the PFOTS packaging treatment.

Figure 7A:
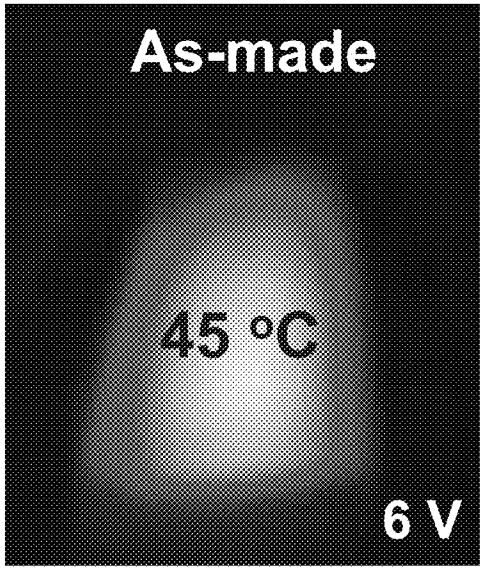
FIG. 7A is a thermal-camera image of an example textile-based electrically conductive heating element coated with a fluoroalkyl-based protective coating during application of an electrical voltage in dry conditions.
Figure 7B:
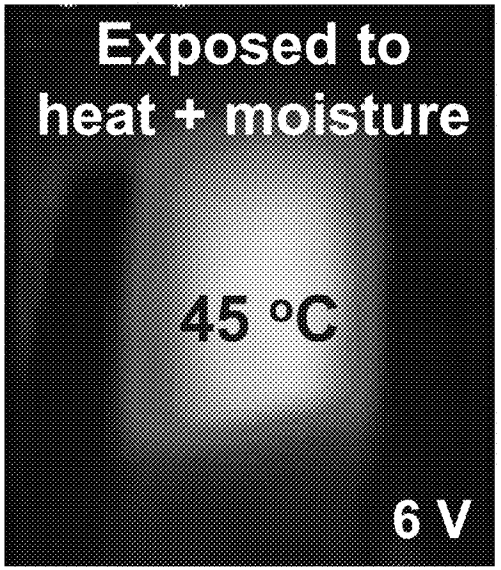
FIG. 7B is a thermal-camera image of the fluoroalkyl-coated textile-based electrically conductive heating element in FIG. 7A during application of an electrical voltage after the coated heating element has been exposed to heat and moisture.

FIGS. 7A and 7B are images from a thermal camera of an example PEDOT-coated textile heating element with a fluoroalkyl-based protective coating applied thereto (e.g., via the PFOTS packaging process described above). FIG. 7A is a thermal image of the flouroalkyl-protected heating element that has not been exposed to external heat or moisture during the application of a voltage to the heating element to induce Joule heating e.g., the flouroalkyl-protected heating element was kept in a cool and thy environment until the Joule heating being shown in FIG. 7A. FIG. 7B is a thermal image of the same flouroalkyl-protected heating element as in FIG. 7A during Joule heating after exposure to external heat and moisture. A comparison of the thermal images in FIGS. 7A and 7B show that the flouroalkyl-packaging process imparted acceptable heat and moisture insensitivity for the resulting heating element.

Figure 8:
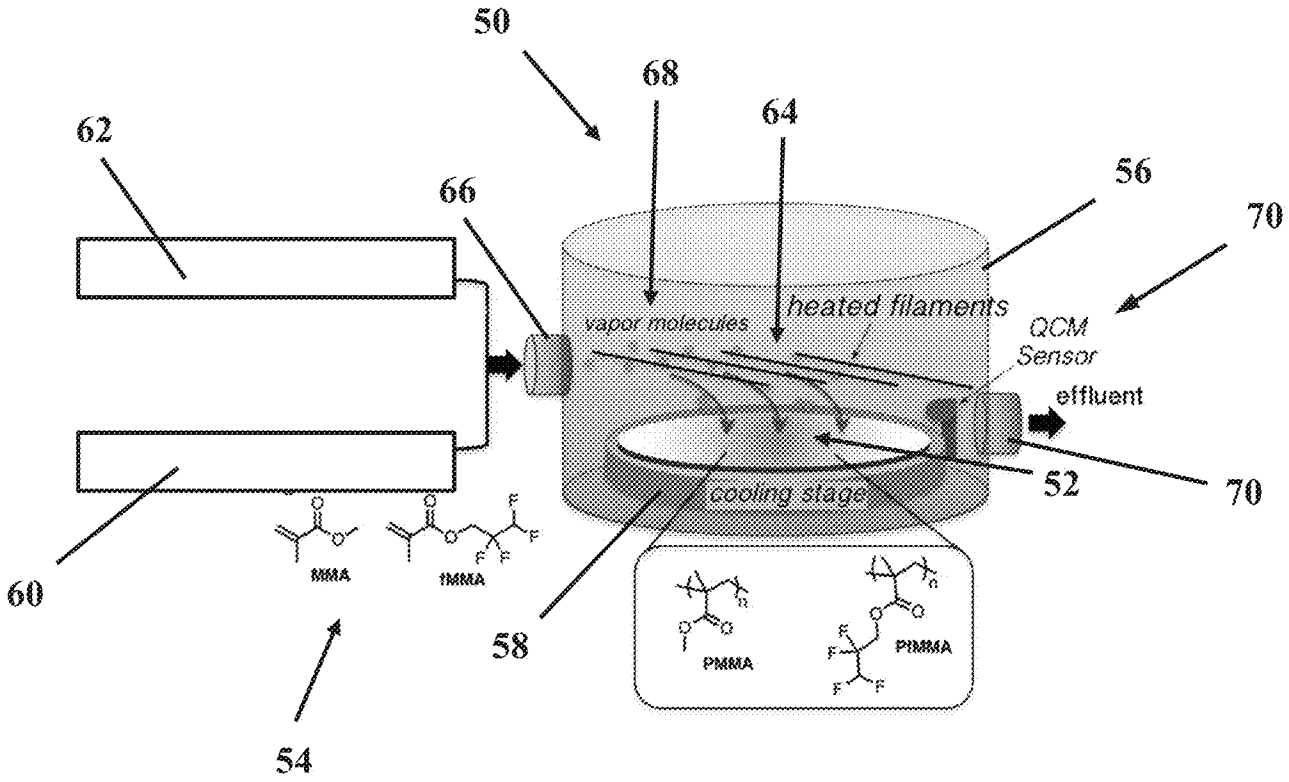
FIG. 8 is a conceptual schematic view of an example apparatus for reactive vapor deposition of a protective coating onto a textile-based electrically conductive heating element.

FIG. 8 shows a schematic diagram of a reactive vapor deposition apparatus 50 for depositing another example of a protective coating onto a fiber or textile-based heating element, such as the example textile heating elements 14 described above, to form a protectively-packaged fabric-based or textile-based heating element (also referred to simply as a "protected heating element" or a "packaged heating element."). The protective coating applied by the protective coating vapor deposition apparatus 50 of FIG. 8 is reactively deposited onto the fiber or textile-based heating element 52, which can be the same or similar to the heating elements 14 described above, via reactive vapor deposition of one or more protective precursor compounds 54, such as one or more vapor-phase monomers that polymerizes on the surfaces of the fiber or textile-based heating element (e.g., onto the outer surface or surfaces of the conductive polymer coating that has been applied onto a fiber or textile-based substrate 12). The polymerized protective precursor compound or compounds form a protective coating comprising a material that electrically insulates the conductive polymer from the surroundings of the textile heating element, and in some examples that prevents or reduces the ingress of moisture or other materials from the environment onto the conductive polymer or into the textile heating element.

As shown in FIG. 8, in an example the protective coating vapor deposition apparatus 50 includes a protective coating reactive vapor deposition chamber 56 into which the one or more protective precursor compounds 54 are fed, such as through a protective precursor feed line 60. In an example, the one or more protective precursor compounds 54 are fed to the deposition chamber 56 in a gaseous or vapor state. In the deposition chamber 56, molecules 68 of the one or more protective precursor compounds 54 are deposited onto one or more fiber-based or textile-based heating elements 52 placed on a deposition stage 58 in the reactive vapor deposition chamber 56. In an example, molecules 68 of the one or more protective precursor compounds 54 react on or at exposed surfaces of the fiber-based or textile-based heating element 52 to form a protective coating comprising a final protective material on the exposed surfaces.

In some examples, the final protective material of the protective coating is a reaction product of a polymerization reaction of the one or more protective precursor compounds 54. For this reason, the one or more protective precursor compounds 54 may also be referred to herein as "monomers 54" because they are polymerized to form the final protective material. In some examples, the polymerization reaction is a chain-reaction type polymerization reaction, which can be initiated by one or more initiator compounds. In an example, the one or more initiator compounds are fed to the deposition chamber 56 via a second initiator feed line 62. In some examples, the one or more initiators are fed to the deposition chamber 56 in a gaseous or vapor state.

As described above, in some examples the protective material is an electrically insulating material that is sufficiently electrically insulating such that the conductive polymer will be electrically isolated from the environment around the packaged heating element. Examples of monomers 54 that can be used to form sufficiently electrically insulating materials included, but are not limited to: acrylic monomers, such as acrylate monomers or methacrylate monomers; cyclophane monomers; and siloxane monomers (including linear or cyclic siloxane monomers). Examples of acrylate or methacrylate monomers include, but are not limited to: methyl methacrylate (also referred to herein as "MMA"); butylacrylate; 2,2,3,3-tetrafluoropropylmethacrylate (also referred to herein as "fluorinated methyl methacrylate" or "fMMA"); 3,3,4,4,5,5,6,6,7,7,8,8,8-tridecafluorooctylacrylate; 2,2,3,3,4,4,4-heptafluorobutylacrylate; and 2,2,3,3,4,4,4-heptafluorobutylmethactylate. Examples of cyclophane monomers include, but are not limited to: [2.2] para-cyclophane and octafluoro[2.2]paracyclophane: Examples of siloxane monomers include, but are not limited to: 1,3-divinyltetramethyldisiloxane and 2,4,6,8-tetramethyl-2,4,6,8-tetravinylcyclotetrasiloxane.

Monomers 54 useful for forming an electrically insulting protective coating can be a hydrocarbon "base" monomer or a substituted monomer (e.g., with one or more hydrogen or methyl groups substituted with a halogen or other substitution element or group, which may itself be a group substituted with a halogen or another substitution element). Halogenated compounds, and in particular fluorinated compounds, have been found to be particularly useful for electrical insulation and for preventing or reducing moisture ingress into a fiber-based or textile-based heating element packaged with the resulting protective coating. For example, as shown in FIG. 8, the one or more protective precursor monomers 54 can include methyl methacrylate (MMA), which is polymerized in the vapor deposition chamber 56 to form polymethylmethacrylate (also referred to herein as "PMMA"). In place of or in addition to the base MMA monomer, the one or more protective precursor monomers 54 can include a substituted MMA, such as a fluorinated MMA (e.g., fMMA), which is polymerized in the vapor deposition chamber 56 to form a poly-fluorinated methyl methacrylate (also referred to herein as "PfMMA").

Examples of initiators that can be used to initiate a polymerization reaction of the one or more of the protective precursor compounds 54, such as the precursor monomers described above, include, but are not limited to: di(tert-butyl)peroxide, tert-butyl-hydroperoxide, and hydrogen peroxide.

In an example, the protective coating vapor deposition chamber 56 includes a temperature regulation apparatus 64 within the deposition chamber 56 to maintain a temperature at specified position or region within the deposition chamber 56. In particular, the temperature regulation apparatus 64 is positioned and configured to control a temperature of the one or more protective precursor compounds 54 (i.e., the one or more precursor monomers) to a specified temperature at a position relative to the position of the fiber-based or textile-based heating element 52 positioned on the deposition stage 58. In an example, shown in FIG. 8, the temperature regulation apparatus 64 comprises one or more heating structures, such as one or more heating elements or heating filaments, placed at a specified distance from the substrate 12 to be coated with the protective material (e.g., the fiber-based or textile-based heating element 52). For this reason, the temperature regulation apparatus 64 will also be referred to hereinafter as the "heating apparatus 64." In the example shown in FIG. 8, the heating filaments of the heating apparatus 64 are positioned proximate to the location where the monomer molecules 68 enter the deposition chamber 56 (e.g., at or proximate to the height of an inlet port 66 through which the monomer molecules 68 are fed). In an example, the heating apparatus 64 includes nichrome (Ni/Cr) filaments 64.

In an example, the heating apparatus 64 is configured to ensure that the monomer molecules 68 are vaporized and are at the specified temperature before being deposited and reacted onto the substrate being coated. The heating by the heating apparatus 64 also acts to decompose the monomer into reactive radicals, e.g., via reaction with molecules 68 of the initiator to form the reactive radicals. In some examples, the specified temperature selected to ensure vaporization of the monomer molecules 68 and decomposition of a significant portion of the monomer molecules 68 to reactive radicals if from about 60° C. to about 150° C. In an example, the heating apparatus 64 (e.g., the heating filaments 64) are heated to a temperature of from about 100° C. to about 200° C. so that the monomer molecules 68 will reach the desired specified temperature.

In some examples, vapor phase for the monomer molecules 68 and/or decomposition into reactive radicals can be caused by reducing the pressure within the deposition chamber 56, such as with a vacuum apparatus (not shown) that creates a vacuum pressure environment in the deposition chamber 56, e.g., via an effluent port 70. In an example, the vacuum pressure environment comprises an absolute pressure within the deposition chamber 56 of about 2 to about 10 mTorr. Reducing the pressure can be performed in place of or in addition to heating the monomer molecules 68 with the heating apparatus 64 (e.g., heating filaments 64), such as by selecting a combination of a specified temperature and the specified pressure that will provide for the desired polymerization and formation of the protective coating on the heating element 52 and at a specified deposition rate.

In some examples, the deposition stage 58 is cooled to a specified stage temperature in order to create a specified temperature gradient between the gas in the deposition chamber 56 (including the monomer molecules 68, the reactive radicals, and the initiator) and the substrate that is being coated (e.g., the fiber-based or textile-based heating element 52). In an example, the deposition stage 58 is cooled with a cooling fluid that is flow through or past or through the deposition stage 58, such as cooling water or an ethylene glycol-water mixture. In an example, the stage temperature to which the deposition stage 58 is cooled is selected to drive the polymerization reaction of the reactive radicals formed from the monomer molecules 68 (e.g., by heating with the heating apparatus 64 or by reducing pressure in the deposition chamber 56, or both) to form the final polymer of the protective coating on the fiber-based or textile-based heating element 52. Cooling of the deposition stage 58 can also help control where the protective coating material will be deposited, e.g., so that most of the molecule molecules 68 or reactive radicals will be deposited onto the fiber-based or textile-based heating element 52 and the deposition stage 58 rather than onto the inner walls of the deposition chamber 56 or onto other structures within the deposition chamber 56 (such as the QCM sensor 36). In some examples, the walls of the deposition chamber 56 can also be heated, e.g., with a separate heater, to further enhance the temperature gradient between the deposition stage 58 and the inner walls of the deposition chamber 56. In an example, the deposition stage 58 is cooled to a stage temperature of from about 0° C. to about 15° C.

In some examples, the protective coating vapor deposition apparatus 50 is configured to produce a protective coating having a thickness of from about 100 nanometers (nm) to about 1 micrometer (μm). The protective coating thickness can be controlled by controlling the deposition rate (e.g., the growth rate of the protective coating on the fiber-based or textile-based heating element 52). In some examples, the deposition rate can be adjusted by controlling one or more of: the partial pressure of the monomer molecules 68 in the deposition chamber 56 (e.g., by controlling the flow rate of the monomer to the deposition chamber 56 through the protective precursor feed line); the partial pressure of the initiator (e.g., by controlling the flow rate of initiator to the deposition chamber 56 through the initiator feed line); chamber pressure; the temperature of the heating filaments 64, and the stage temperature to which the deposition stage 58 is cooled. In an example, shown in FIG. 8, the protective coating deposition apparatus 50 includes a quartz crystal microbalance sensor 72 ("QCM sensor 72") positioned at or proximate to the deposition stage 58 in order to measure the growth rate and thickness of the protective coating on the fiber-based or textile-based heating element 52 and to enable control of one or more of these parameters in order to control the protective coating growth rate.

The vertical distance from the inlet of the monomer molecules 68 (e.g., the inlet port 66) and the heating apparatus 64 to the deposition stage 58 is selected so that the monomer molecules 68 and/or the reactive radicals will sufficiently disperse as they diffuse or float down to the deposition stage 58, and in particular so that the concentration of the monomer molecules 68 and/or reactive radicals will be uniform or substantially uniform across all of or substantially all of the surface area of the fiber-based or textile-based heating element 52 being coated. Uniform concentration of the monomer molecules 68 and/or reactive radicals results in uniform or substantially uniform growth of the protective coating on the fiber-based or textile-based heating element 52, which is desirable to more precisely control the thickness of the protective coating. However, if the distance from the monomer inlet port 66 and/or the heating apparatus 64 to the deposition stage 58 is too large, the monomer/radical concentration may be sufficiently uniform, but the growth rate of the protective coating may be too slow, which increases the time needed to grow the protective coating to a specified thickness. In an example, the distance from the monomer inlet port 66 and/or the heating apparatus 64 to the deposition stage 58 is from about 10 cm (about 4 inches) to about 30 cm (about 12 inches). However, the exact distance selected can depend on many other factors, including the specific monomer or monomers being used, the partial pressure of the monomer and initiator in the deposition chamber 56, the overall pressure in the deposition chamber 56 and/or, the specified temperature to which the monomer molecules 68 will be heated, and the stage temperature to which the deposition stage 58 is cooled.

In some examples, the reactive vapor deposition apparatus 50 described above produces a protective coating that conformally or substantially conformally coats the conductive-polymer coated textile heating element 52 with the protective material. Even if the packaged heating element 52 does not include a fully conformal coating of the protective material on the surface or surfaces of the fabric or textile-based heating element 52, the reactive vapor deposition apparatus 50 of FIG. 8 can coat a larger percentage of the surfaces of a fabric-based or textile-based heating element 52 than most other deposition methods (including the PFOTS-based packaging method described above), especially for fabric or textile substrates with high thread or fiber density resulting in a large number of overlapping fibers or threads. A highly conformal coating of the protective material prevents or substantially minimizes the possibility of electrical contact between a wearer of an article that incorporates the packaged heating element 52 and the conductive polymer material of the textile heating element 52, either by direct contact between the wearer (e.g., the wearer's skin) and the conductive polymer, or via a water connection if the article gets wet.

FIBER OR THREAD-BASED HEATING ELEMENTS

The primary type of heating element described above is one formed from a textile-based substrate. However, the deposition methods described above can also be used to apply the conductive polymer to a fiber-based or thread-based substrate (e.g., a fiber or threading, which will be referred to hereinafter as a "fiber substrate") in order to form a fiber-based or threading-based heating element (referred to hereinafter simply as a "heating element thread"). A fiber heating element can be used, for example, to form an embroidered heater or a woven textile heater comprising individual heating fibers.

Figure 9:
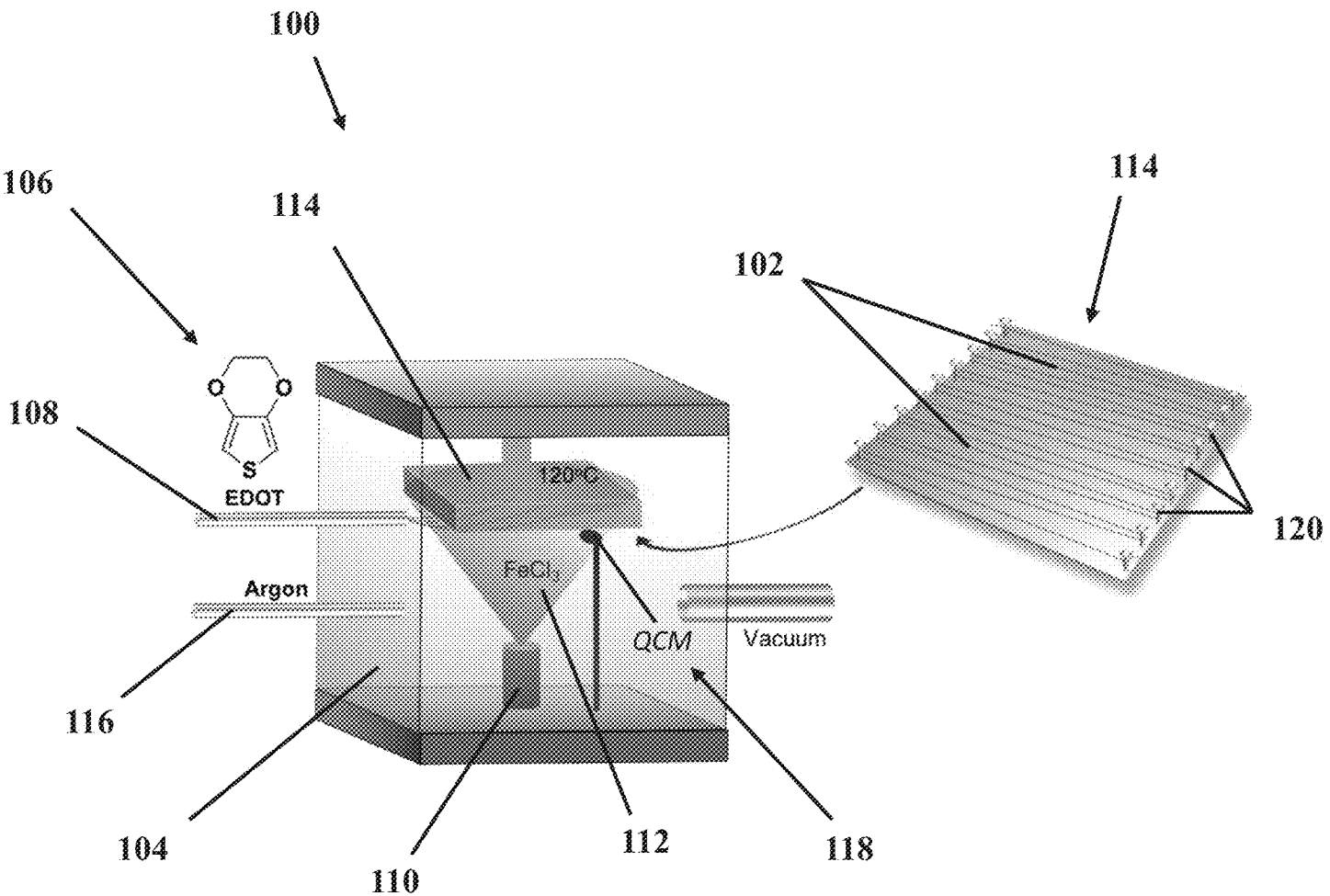
FIG. 9 is a conceptual perspective view of an example apparatus for reactive vapor deposition of an electrically-conductive polymer onto a threading or fiber substrate in order to convert the threading or fiber substrate into an electrically-conductive thread capable of being used for a resistive heating element.

FIG. 9 shows a schematic diagram of an example reactive vapor deposition apparatus 100 configured to deposit a conductive polymer onto one or more fiber substrates 102. Many of the components and structures of the example conductive polymer deposition apparatus 100 shown in FIG. 9 is substantially similar or identical to the conductive polymer reactive vapor deposition apparatus 10 configured to deposit the conductive polymer onto a textile substrate shown in FIG. 1. For example, like the apparatus 10 of FIG. 1, the apparatus 100 of FIG. 9 includes a vapor deposition chamber 104 into which is fed one or more reactive precursor compounds 106 that reactively form the conductive polymer (e.g., EDOT that forms PEDOT) via a precursor feed line 108. The apparatus 100 of FIG. 9 also includes an oxidant heater 110 that forms an oxidant vapor cloud 112 (e.g., a $FeCl_3$ oxidant) that is directed toward an inverted deposition stage 114 onto which is coupled the fiber substrate or substrates 102 to be coated with the conductive polymer. The example apparatus 100 of FIG. 9 also includes a second feed inlet 116, such as for an inert gas such as argon to control the pressure within the deposition chamber 104 above a specified deposition pressure (e.g., to a pressure of at least 300 mTorr, for example up to as much as 500 mTorr or more), and a QCM sensor 118 to measure and provide for control of the growth of the conductive polymer film on the substrate).

The primary difference between the example apparatus 100 of FIG. 9 and the apparatus 10 of FIG. 1 is that the apparatus 100 of FIG. 9 includes a deposition stage 114 that is configured for one or more fiber substrates 102 to be coupled thereto in order to deposit the conductive polymer onto the one or more fiber substrates 102 and produce one or more heating element threads. In the example shown in FIG. 9, the deposition stage 114 includes a plurality of thread posts 120 around or through which the one or more fiber substrates 102 can be threaded so that the fiber substrate 102 is separated from (e.g., elevated away from) the deposition stage 114. This design is intended to mimic an array of thread spools. The elevation of the fiber substrate 102 away from the deposition stage 114 can provide for deposition of the conductive polymer onto all of or substantially all of the circumference of the fiber substrate 102 (e.g., around all or substantially all 360° of the fiber substrate). In some examples, the deposition apparatus 100 for depositing the conductive polymer onto the one or more fiber substrates 102 can provide for conformal or substantially conformal coating of each of the one or more fiber substrates 102. For example, the y am substrate 40 shown in the photograph of FIG. 5 was coated with PEDOT using a deposition stage similar to that shown in FIG. 9, which resulted in the substantially conformal coating of the PEDOT (as described in more detail above).

In some examples, this design of deposition stage 114 can accommodate a relatively long length of fiber substrate 102, e.g., as much as 2 meters (about 7 feet) or longer of fiber substrate 102 when carefully wound in different layers of the fiber substrate 102. Of course, more efficient designs of the deposition stage 114 to accommodate different lengths and configurations of fiber substrate 102 can be designed without varying from the scope of the present disclosure.

In some examples, the deposition apparatus 100 for deposition of the conductive polymer onto one or more fiber substrates 102 can be operated at substantially the same operating conditions as described above for the deposition apparatus 10 of FIG. 1 configured to deposit the conductive polymer onto a textile substrate 12. For example, the fiber substrate deposition apparatus 100 can be operated using the same precursor compound or compounds 106 (e.g., EDOT) to produce the same conductive polymer coating (e.g., PEDOT), the same oxidant (e.g., $FeCl_3$), at the same relative high pressures, and at the same temperatures. The resulting heating element threads can also be further packaged with the same protective coatings described above and discussed with respect to FIGS. 7A, 7B, and 8.

One or more of the coated heating element threads can be used to form a larger textile structure. For example, FIG. 10 is a photograph of an example textile sheet 122 that was produced by a simple-weaving of the coated yarn 40 of FIG. 5 into the textile sheet. FIGS. 11A-11D are thermal photographs of the plain-woven textile sheet 122 of FIG. 10 at different applied voltages, which shows the electrothermal response of the textile sheet 122 to various voltages. As can be seen, temperatures near human body temperature (e.g., 37° C.) were reached with an applied voltage of 4.5 volts (FIG. 11C), while 6 volts resulted in a temperature of 44° C. (FIG. 11D).

In some examples, vapor-deposited coatings of the conductive polymer (e.g., PEDOT) do not become rubbed off during weaving embroidering, or otherwise handling the coated heating element threads, or only have minimal rubbing off of the conductive polymer material. Other methods of manipulating the coated heating element threads or yarns can include knitting, com, complex weaving operations, embroidering formation into non-woven textiles, winding onto a spindle structure for further processing, lapping or any other method known in textile processing or composite structure shaping now known or later discovered. In short, the vapor deposition apparatus 100 of FIG. 9 and the methods described herein for using it can provide for high-flexibility threads or yarns that can be used to fabricate customized heating elements via any method that can be used for shaping or otherwise fabricating conventional threading fibers, or yarns to form textile articles.

MULTI-LAYERED TEXTILE HEATING ELEMENTS

In some examples, a plurality of sheets of textile heating elements are stacked into a multi-layer heating stack. Each textile heating element of the heating stack can be (a) a textile heating element 14 formed by coating an existing textile substrate 12. (such as the example substrates 12 of FIGS. 2A and 2B) with a conductive polymer e.g., PEDOT) via the vapor deposition method described above; or (b) a textile heating element formed by first coating a fiber-based or thread-based substrate 102 to form a heating element thread (such as the cotton yarn substrate that is then coated with PEDOT, as shown in FIG. 5) and then consolidating one or more of the coated heating element threads into a textile heating element (e.g., by weaving knitting, or embroidering the one or more heating element threads to form a textile heating element, such as the woven textile sheet 122 shown in FIGS. 10 and 11A-11D).

Figure 12:
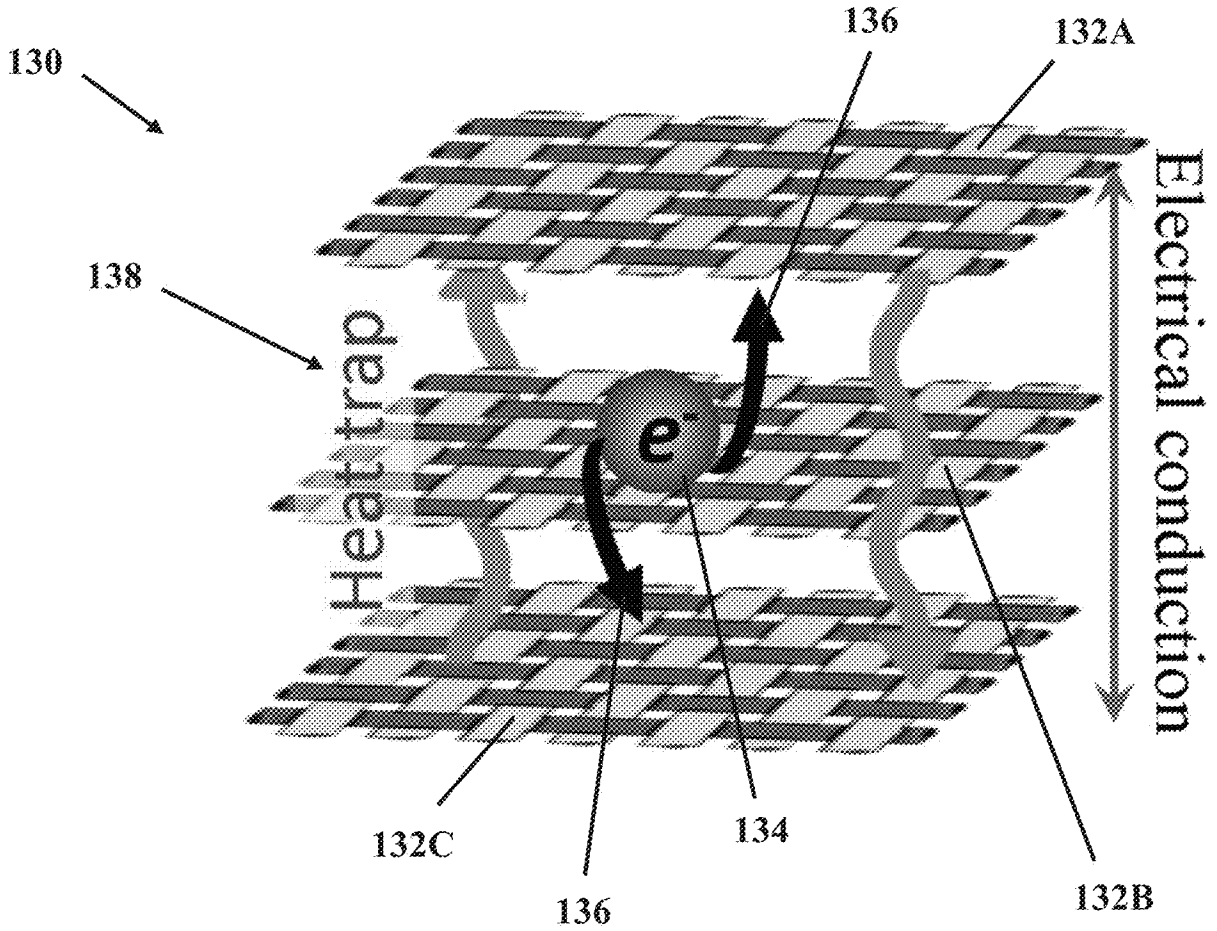
FIG. 12 is a conceptual diagram of a heating structure comprising a plurality of textile heating elements in a multi-layer stack.

FIG. 12 is a conceptual view of an example heating stack 130 shown that is formed from three separate textile heating elements 132A, 132B, and 132C, a first or upper heating element sheet 132A, a second or middle heating element sheet 132B, and a third or lower heating element sheet 132C (collectively referred to as "textile heating elements 132" or simply "heating elements 132"). FIG. 12 is shown as an exploded view with the three textile heating elements 132 being separated from one another. However, when the plurality of textile heating elements 132 are stacked into the multi-layer structure of the heating stack 130, the conductive polymer coating of one of the textile heating elements 132 can be in electrical contact with the conductive polymer coating of at least one adjacent textile heating element 132. For example, the middle heating element layer 132B (e.g., the second textile heating element 132B), is in electrical contact with one or both of the top heating element layer 132A (e.g., the first textile heating element 132A) and the bottom heating element layer 132C (e.g., the third textile heating element 132C). This can allow electrons flowing as electrical current 134 through any one of the textile heating elements 132 can be transferred to an adjacent textile heating element 132 via the electrical contact between the adjacent textile heating elements 132. For example, current 134 flowing through the middle heating element 132B can be transferred to the top heating element 132A or to the bottom heating element 1320 (as represented by the arrows 136 in FIG. 12). Similarly, current 134 flowing through the top heating element 132 A or through the bottom heating element 132C can be transferred to the middle heating element 132B.

The electrical contact between adjacent textile heating elements 132 in a multi-layer heating stack 130 like the example shown in FIG. 12 increases the overall cross-sectional area of the electrical-conduction channel for the entire heating stack 130 without substantially increasing the overall size of the heating stack 130 compared to the individual textile heating elements 132. In examples where the fibers or threads of the textile heating element are substantially completely coated with the conductive polymer, and in particular where the conductive polymer conformally or substantially conformally coats the threading or fibers of the textile heating elements 132, then this increase in the cross-sectional area of the conduction channel can be particularly pronounced.

The electrical contact between adjacent textile heating elements 132 in a multi-layer heating stack 130, and in some examples the corresponding increase of conduction channel cross-sectional area, can reduce the overall resistance (e.g., lateral and transverse resistance) for the entire heating stack 130 as compared to the individual textile heating elements 132 that form the layers of the multi-layer stack 130. Multi-layer heating stacks 130 can also impede dissipation of generated heat to the ambient environment in cold weather by forming a heat trap 138, in one or more air layers within or between the layers 132 of the multi-layer heating stack 130 or because of infrared reflection, in much the same way that layered conventional textiles do. Therefore, it would be expected that heating structures comprising a plurality of conductive polymer coated textile heating elements 132 arranged in a multi-layer heating stack 130 will demonstrate both higher electrical efficiency and higher heating temperatures compared to singe-layered textile heating elements 132.

In one example, when multiple textile heating elements were layered together, the overall lateral and transverse resistance of the stack linearly decreased with the number of layers in the stack. TABLE 2 shows the effect of the multiple layers in heating stacks made from pineapple-fiber textile substrates (e.g., those shown in FIG. 2A) coated with PEDOT conductive polymer and in heating stacks made from cotton-fiber textile substrates (e.g., those shown in FIG. 2B) coated with PEDOT conductive polymer. Specifically, TABLE 2 shows the lateral resistance measured across a length of one (1) inch (about 2.5 cm) for a single textile heating element made from each textile substrate material (e.g., a one (1) layer of a PEDOT-coated textile heating element), and for a two-layered and a three-layered heating stack for each textile substrate material at an applied voltage of 3 V. TABLE 2 also shows the measured resistance for the three-layered heating stack when 4.5 V is applied. The measured resistances compared to the number of layers in the heating structure from TABLE 2 is plotted in FIG. 13, with data series 140 representing a stack made with pineapple fiber fabric and data series 142 representing a stack made with cotton fabric.

TABLE 2

Electrothermal properties of layered PEDOT-coated fabrics

| | Pineapple fiber fabric | | | | Cotton fabric | | | |
|---|---|---|---|---|---|---|---|---|
| | Voltage | | | | | | | |
| | 3 V | | | 4.5 V | 3 V | | | 4.5 V |
| | Layers | | | | | | | |
| | 1 | 2 | 3 | 3 | 1 | 2 | 3 | 3 |
| Resistance | 102 Ω | 53 Ω | 32 Ω | 32 Ω | 138 Ω | 72 Ω | 45 Ω | 45 Ω |
| Temperature | 24° C. | 31° C. | 38° C. | 57° C. | 23° C. | 29° C. | 35° C. | 56° C. |

Figure 13:
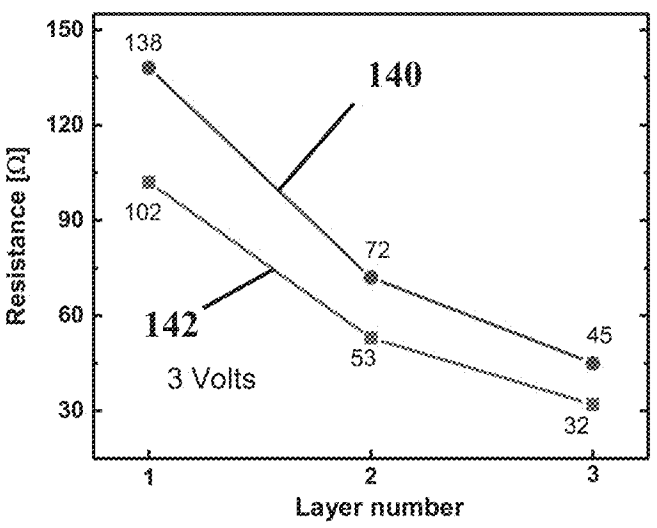
FIG. 13 is a graph of the lateral resistance (in ohms, Ω) of textile-based electrically conductive heating stacks made from one (1), two (2), and three (3) layers of PEDOT-coated pineapple fiber fabric and of PEDOT-coated cotton fabric.

As can be seen in TABLE 2 and FIG. 13, the lateral resistance for a single-layer textile heating element was 102Ω for the PEDOT-coated pineapple fiber textile heating element and 138Ω for a single-layer PEDOT-coated cotton fiber textile heating element. For both the pineapple fiber and the cotton fiber textile heating elements, the resistance of a double-layer heating stack was about one half (½) of the single-layer resistance (from 102Ω to 53Ω for the pineapple fiber heating stack, and from 138Ω to 72Ω for the cotton fiber heating stack), and a triple-layer heating stack had a resistance that was about ⅓ of the single-layer textile heating element (32Ω compared to 102Ω for the pineapple fiber heating stack, and 45Ω compared to 138Ω for the cotton fiber heating stack). This linear trend suggests that near-ideal contact between the fabrics layers can be achieved with simple, physical layering.

The theoretical equilibrium temperature that can be achieved by a heating element structure due to Joule heating is provided by Equation 1.

$$T = \frac{VI}{hA} + T_a \quad [1]$$

where T is the expected equilibrium temperature, V is the supplied voltage, I is the current through the heating element structure, h is the convective heat transfer coefficient, A is the device surface area, and $T_a$ is the ambient air temperature. Equation 1 can be rewritten to Equation 2.

$$T = \frac{V^2}{RhA} + T_a \quad [2]$$

where R is the lateral resistance for the entire heating element, e.g., the resistance across the textile heating element for a single-layer device, or the resistance across the entire multi-layer heating stack. As can be seen by Equation 2, the expected temperature increase due to Joule heating is inversely proportional to the overall lateral resistance across the device.

Therefore, the reduction in lateral resistance for the multi-layer heating stacks is expected to result in a corresponding improvement in the heated temperature achieved. TABLE 2 also includes data for the change in temperatures achieved (over the ambient temperature) for the single-layer textile heating element and for the multi-layer heating stacks at the same applied voltages, which demonstrates that this expected improvement in the achieved temperature does occur. The temperature data relative to the number of heating element layers in the heating stack from TABLE 2 is plotted in FIG. 14, with data series 146 representing the temperature for stacks made from the pineapple fiber fabric and data series 148 representing the temperature for stacks made from the cotton fiber fabric. For the PEDOT-coated pineapple fiber heating elements, a single layer demonstrated a 5° C. temperature increase with an applied voltage of 3 V. Based on this, the temperature increase for multi-layered heating stacks of the same PEDOT-coated pineapple fiber heating elements that is predicted from Equation 2 is 10° C. for a double layer and 15° C. for a triple layer were to be used (which is plotted as the dashed line 150 in FIG. 14). The actual temperature increase measured for the double-layered and triple-layered heating stacks of the pineapple fiber fabric layers (data series 146) was 12° C. and 19° C., respectively, which was 20% and 26% higher than the temperatures predicted from Equation 2.

Figure 14:
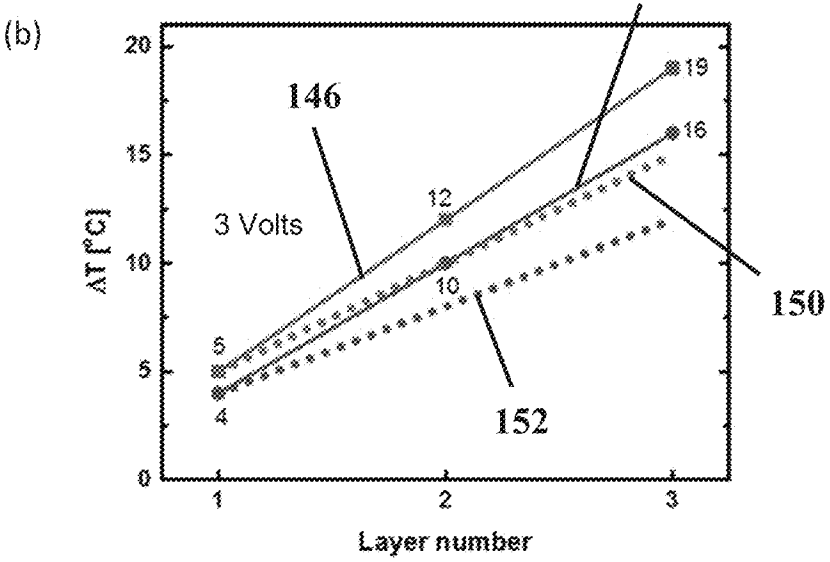
FIG. 14 is a graph of the change in temperature relative to ambient temperature for the one (1), two (2), and three (3) layered PEDOT-coated pineapple fiber heating stacks and cotton fiber heating stacks.

For a single-layer PEDOT-coated cotton fiber heating element, the temperature increase achieved was 4° C., corresponding to a predicted temperature increase, based on Equation 2, of 8° C. and 12° C., respectively, for the double-layered and triple-layered heating stacks (plotted as dashed line 152 in FIG. 14). The actual temperature increase for the cotton fiber heating stacks was measured at 10° C. and 16° C. for the double-layered and triple-layered heating stacks, respectively (data series 148), which is 25% and 33% higher than was predicted by Equation 2. The measured temperature increases that were higher than the temperature predicted by Equation 2 was expected because of the expected heat retention between layers, described above. TABLE 2 also includes data for the average equilibrium temperatures achieved with an applied voltage of 4.5 V for triple-layered pineapple fiber and triple-layer cotton fiber heating stacks. The triple-layer pineapple fiber heating stack reached 57° C. and the triple-layered cotton heating stack reached 56° C., both of which are adequate for wearable electric heaters.

Because the electrical contact between adjacent layers is necessary for this transfer of electrical current between adjacent layers, each layer of the multi-layer heating stack is not packaged with an electrically-insulating protective coating (such as the PFOTS coating described above or the protective coating deposited by the vapor deposition apparatus 50 described above with respect to FIG. 8), at least not before the individual textile heating elements are stacked together to form the multi-layer heating stack. Once the multiple layers of the textile heating elements are stacked together and each layer is in electrical contact with one or more adjacent layers, than the entire heating stack could be packaged with an electrically-insulating protective coating or electrically-insulating layers, so long as the process of applying the electrically-insulting coating or layers does not cause the electrical contact between adjacent textile heating elements of the heating stack to be broken (at least not along more than a small percentage of the surface area of the textile heating element).

Figure 15:
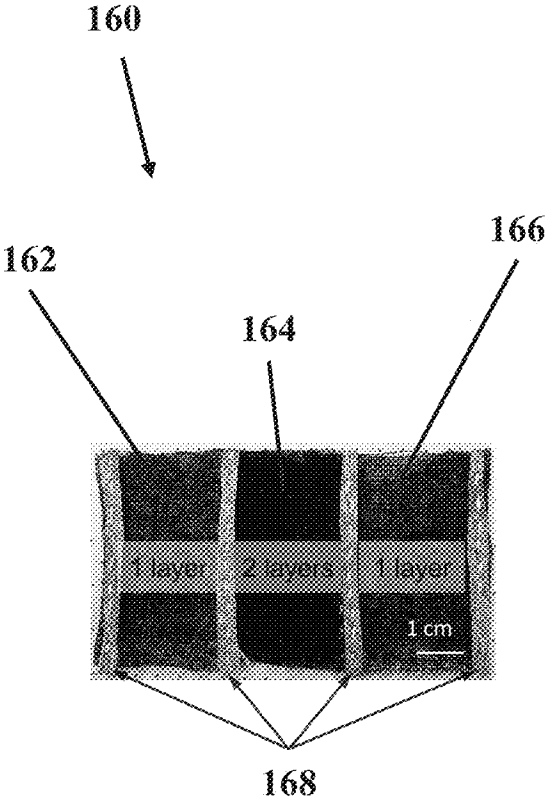
FIG. 15 is a photograph of an example "fabric circuit" made from textile-based electrically conductive heating structures made from varying numbers of layers of textile heating elements connected in series.

In some examples, the varying lateral resistances for heating stacks having different numbers of heating element layers can be used to fabricate specified temperature gradients in an article by creating "circuits" of combinations of single heating elements or multi-layer heating stacks. FIG. 15 shows an optical image of an example Joule heating "fabric circuit" 160 comprising three separate heating stacks sewn together in "series" at their edges with regular cotton thread. The example fabric circuit heating structure 160 shown in FIG. 15 includes three heating sections, a first heating section 162 (e.g., left-most section 162 in FIG. 15), a second heating section 164 (e.g., middle section 164 in FIG. 15) connected to the first heating section 162 along an edge, and a third heating section 166 (e.g., right-most section 166 in FIG. 15) connected along an opposing edge of the second heating section 164. in the example shown in FIG. 15, the first heating section 162 comprises a single-layer PEDOT-coated cotton fiber heating element having a measured lateral resistance of 148Ω. The second heating section 164 comprises a heating stack made from a double layer of the same PEDOT-coated coated heating elements, which had a measured combined lateral resistance of 69Ω. The third heating section 166 is substantially identical to the first heating section 162 in that it is a single-layer PEDOT-coated cotton fiber heating element, except that the third heating section had a measured having a measured lateral resistance of 143Ω.

Narrow strips of copper fabric 168 were sewn onto overlap ping edges between the first heating section 162 and the second heating section 164 (e.g., along the first or left-most edge of the second heating section 164) and between the second heating section 164 and the third heating section 166 (e.g., along the opposing second or right-most edge of the second heating section 164). Similar strips of copper fabric were also sewn onto the outside edges of the first heating section 162 and the third heating section 164 for connection to a voltage source. The copper fabric strips were included to help ensure a uniform electric field across the junctions between adjacent heating sections 162, 164, 166 and at the voltage source connection points. However, as noted above, because of the conductive nature of the conductive polymer coating as well as the complete or substantially complete coverage of the textile heating elements by the vapor deposition methods described above, a metal-based electrode such as the copper fiber is not necessary for operation of all embodiments of heating fabric circuits.

Figure 16:
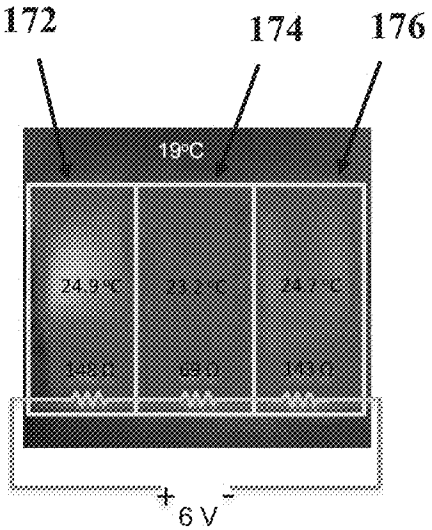
FIG. 16 is a thermal-camera image of the fabric circuit of FIG. 15 while 6 volts of electricity is being applied across the entire fabric circuit.
Figure 17:
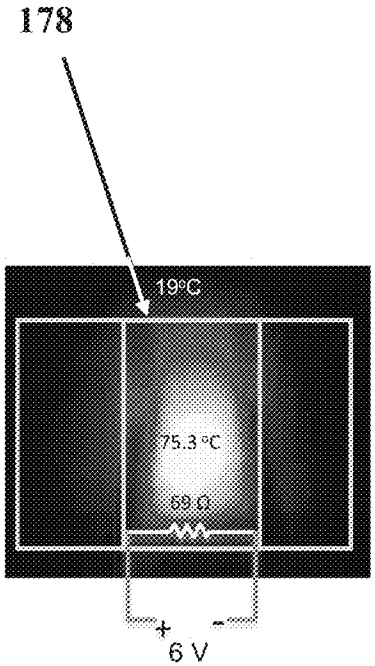
FIG. 17 is a thermal-camera image of the fabric circuit of FIG. 15 while 6 volts of electricity is being selectively applied across only the middle structure of the fabric circuit.

FIG. 16 is a thermal camera image of the fabric circuit 160 shown in FIG. 15 after a voltage of 6 V was applied across the entire fabric circuit with the three fabric heating sections 162, 164, 166 being equivalent to three separate resistors connected in series and thus shared the same current (as shown by the overlaid equivalent circuit shown in FIG. 16). As shown in FIG. 16, a first heated area 172, which is associated with the first heating section 162 (e.g., the single-layer heating element with a resistance of 148Ω) reached a temperature of about 24.9° C. (from an original ambient temperature of 19° C.), a second heated area 174, which is associated with the second heating section 164 (e.g., the double-layered heating stack with a resistance of 69Ω) reached a temperature of 23.2° C., and a third heated area 176, which is associated with the third heating section 166 (e.g., the single-layered heating element with a resistance of 143Ω) reached a temperature of 24.7° C. The resulting temperature increases in the sections 162, 164, 166 was primarily determined by the most resistive section, e.g., the 148Ω of the first heating section 162. When the same voltage was applied only across the least-resistive section (e.g., the 69Ω for the second heating section 164), as shown in the thermal image in FIG. 17, a resulting heated area 178 reached an equilibrium temperature of 75.3° C. after about 20 seconds. The different responses of the heating structure 160 can be used to form various thermal gradient patterns using a combination of sewing patterns, fabric layering, and simple circuit design.

RESPONSE TIME AND HEATING STABILITY

Figure 18:
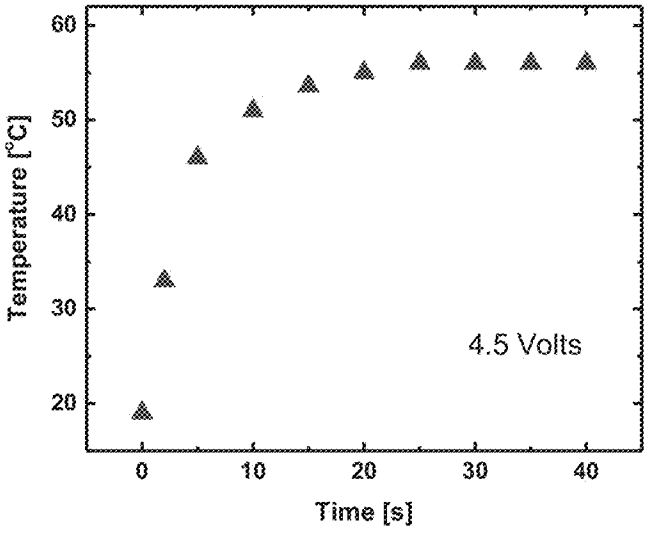
FIG. 18 is a graph of the temperature of a three-layered textile-based electrically conductive heating element comprising three coated fabric layers during a startup period of applying 4.5 volts of electricity to the three-layered heating element.
Figure 19:
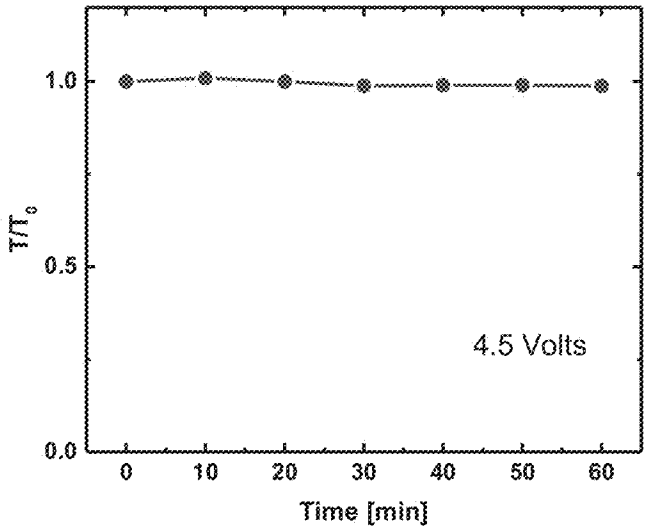
FIG. 19 is a graph of the temperature of the three-layered heating element of FIG. 18 relative to the initial temperature (after the startup period of FIG. 18) for a period of one hour (60 minutes).

Response times and heater stability under constant operation were measured an example triple-layered heating stack of cotton fiber heating elements that were not packaged with a protective coating. FIG. 18 shows a plot of the temperature of the example triple-layered heating stack over an initial startup period of about 40 seconds after commencement of the application of 4.5 V to the heating stack. FIG. 18 shows a plot of the temperature of the example shows the heating response, and FIG. 3*f* shows the stability. FIG. 19 shows the ratio of the measured temperature to the initial equilibrium temperature (e.g., the current measured temperature divided by 56° C.) of the same example triple-layer heating stack during constant application of the 4.5 V for a period of one hour. As can be seen in FIG. 18, within 20 seconds, an equilibrium temperature of about 56° C. was attained. FIG. 19 shows that the equilibrium temperature was stably held by the example heating stack for period of one hour of constant operation.

EXAMPLES

Various embodiments of the present invention can be better understood by reference to the following Examples which are offered by way of illustration. The present invention is not limited to the Examples given herein.

For all examples below, the chemicals used were purchased from Sigma-Aldrich (St. Louis, Mo., USA) and used without further purification, Scanning electron microscopy (SEM) was performed using a FESEM Magellan 400, FEI Company (Hillsboro, Oreg., USA). Film thicknesses were measured on a Dektak 150 profilometer, Veeco Instruments, Inc. (Plainview, N.Y., USA). Surface sheet conductivities of conductive polymer-coated substrates, reported in units of Ω/□, were calculated from resistivity measurements made using a custom-built four-point probe test station. Lateral resistances, i.e., the horizontal resistance across the short axis of a textile heating element, reported in units of Ω, was measured using standard stainless steel probe tips of an ohm meter. Joule heating was powered by commercially -available alkaline batteries. Thermal images were taken using an IR imaging camera, FLIR Systems, Inc. (Wilsonville, Oreg., USA).

Example 1—PEDOT-Coated Textile Heating Elements

Vapor phase polymerization of 3,4-ethylenedioxythiophene (EDOT) to form poly(3,4-ethylenedioxythiophene) (PEDOT) coatings on textiles was carried out in a custom-built reactive vapor or deposition apparatus comprising a cube-shaped stainless steel deposition chamber. A downwards-facing substrate holder/deposition stage was located on the top of the deposition chamber (e.g., the apparatus 10 shown in FIG. 1). The downward-facing substrate holder/deposition stage was kept at a temperature of 120° C. Solid $FeCl_3$ oxidant was sublimed inside the chamber using a crucible heater, Luxel Corporation (Friday Harbor, Wash., USA). A glass ampule containing EDOT was heated with resistive heating tape to 90° C. and the resulting monomer vapor was introduced into the evacuated deposition chamber via a side inlet (e.g., as shown in FIG. 1), controlled by a needle valve. The needle valve was only opened slightly so that the EDOT monomer vapor introduced in the deposition chamber did not immediately condense. Under this condition, the $FeCl_3$ oxidant was the limiting reagent for the polymerization reaction rather than t he EDOT monomer. The temperature of the oxidant crucible heater was manually adjusted during deposition to maintain a film growth rate of 10 Å/s before tooling correction. The pressure inside the deposition chamber was tuned between 100 mTorr and 500 mTorr by introducing and controlling an argon gas flow in addition to the EDOT monomer and the $FeCl_3$ oxidant flux. Although depositions carried out at 500 mTorr yielded textile electrodes with the highest conductivities, the high pressure caused $FeCl_3$ to diffuse into and clog the EDOT monomer inlet tube. To maintain chamber longevity, 300 mTorr was used to create the Joule heating elements tested.

Film thickness was monitored by a quartz crystal microbalance (QCM) located inside the cubic chamber. A corrective tooling factor for the readout obtained from the QCM sensor was obtained as follows. Silicon substrates were coated with films of varying thickness ("QCM reported") at three different monomer:oxidant flow rate ratios, rinsed with $H_2SO_4$/methanol, and the resulting film thickness ("actual thickness") measured using a profilometer. A tooling factor was obtained by taking the ratio of the actual film thickness after rinsing to the thickness reported by the QCM sensor when the tooling factor was set as 100%. The tooling factor was found to be 0.5 for all monomer: oxidant flow rate ratios.

Textiles used as substrates were used as received, without washing. After vapor deposition, the coated substrates were rinsed with 1 M aqueous HCl for 2 minutes to completely remove trapped iron salts, followed by methanol to remove residual monomer and HCl from the polymer coatings. The coated and washed substrates were then dried overnight in air before electrothermal measurements. The PEDOT coatings thus obtained remained stably doped even after rinsing and storage under ambient conditions. For one example of a 1 cm×1 cm cotton square, the measured mass before coating was 27.664 mg with a measured mass after coating with a 1.5 micron thick PEDOT film of 27.829 mg, a 0.6% increase in mass.

As discussed above, significant guns were obtained when the background chamber pressure during deposition was increased using inert argon as. (See TABLE 1 and discussion above). A seven-fold decrease in resistance was observed when pineapple fiber fabrics were coated with PEDOT at a chamber pressure of 300 mTorr, instead of 100 mTorr. A further five-fold decrease was Observed when the chamber pressure was increased to 500 mTorr. Similar effects were also observed for cotton squares coated with PEDOT, with a chamber pressure of 500 mTorr also yielding the lowest measured lateral resistances across the plain-woven swatch. As is also discussed above, at 100 mTorr, the warp and weft threads acted as each other's shadow masks and no PEDOT coating could be found in the buried interfaces where the warp thread crossed over the weft thread (or vice versa) because of inefficient diffusion of reactants. In contrast, at 500 mTorr, these buried interfaces were coated with PEDOT. Indeed, near 360o coverage of all the warp and weft threads of the plain-woven fabric swatch were observed when the vapor coating was performed at 500 mTorr (see comparison of FIGS. 4A and 4B, discussed above).

Two commercially-available textiles were used to produce PEDOT-coated heating elements: pineapple fiber and cotton fiber fabrics (shown in FIGS. 2A and 2B and discussed above). These textiles are lightweight, porous (e.g., breathable and amenable to air flow through the fabric) and commonly used to create garments. A 1.5 micron thick PEDOT film was vapor deposited onto both the pineapple fiber textile and the cotton textile using a system similar to that shown in FIG. 1. This coating thickness was two to three times larger than that which had been reported in earlier works. The thick conductive coating formed was selected so that sufficient current density could be supported to observe Joule heating.

FIGS. 2A and 2B are scanning electron micrograph (SEM) images of example heating elements made from the pineapple fiber textile substrate and from the cotton fiber textile substrate, respectively. The SEM images of FIGS. 2A and 2B show that highly-conformal coatings of the PEDOT were produced on both the pineapple fiber textile substrate and the cotton fiber textile substrate, regardless of the morphology of microfibrils in the constituent textiles. Due to the conformality of the coating, the porosity and breathability of the textile substrates remained unaltered after PEDOT coating. Breathability and porosity of the textile heating element is not readily demonstrated by previously-reported conductive cloths obtained by in situ solution polymerization. The measured total weight of the textile substrates only increased by 1%, at most, after vapor coating with the 1.5 μm-thick PEDOT film. A difference in hand feel between the coated and uncoated textile substrates was not evident to the touch of bare fingers. The PEDOT-coated textile heating elements remained lightweight and breathable after coating and retained their natural texture/hand feel, even with a PEDOT coating as thick as 1.5 μm.

Figure 20B:
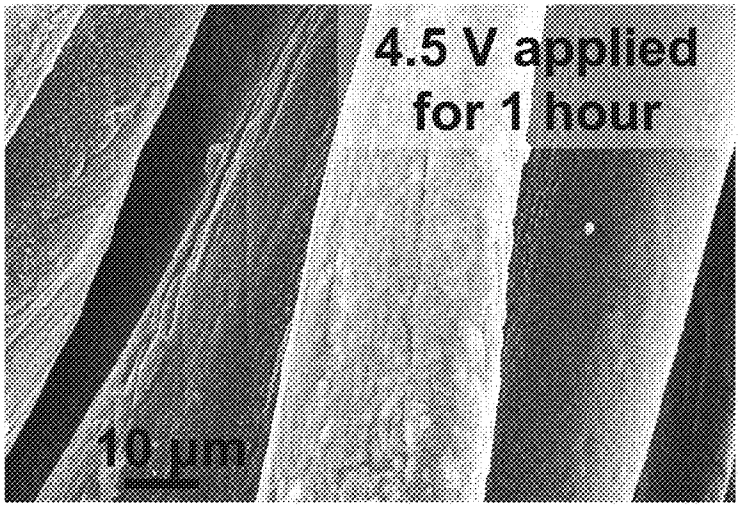
FIG. 20B is an image from a scanning electron microscope of the example textile-based electrically conductive heating element from FIG. 20A after applying 4.5 V for one (1) hour, as discussed in EXAMPLE 1.
Figure 20A:
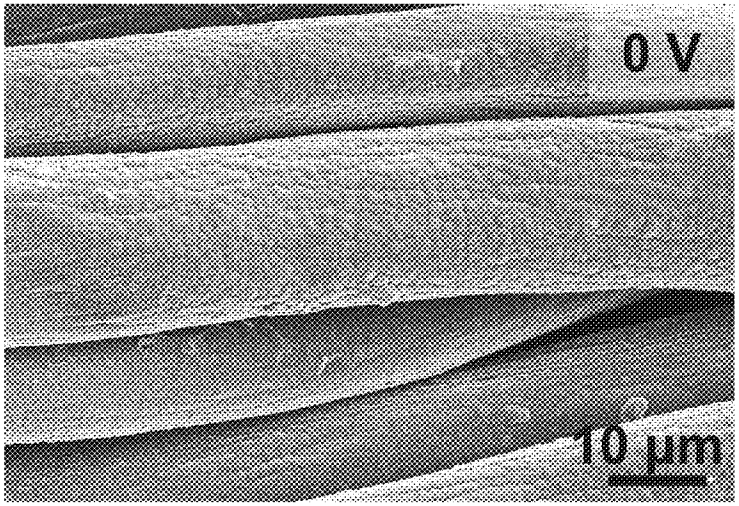
FIG. 20A is an image from a scanning electron microscope of an example textile-based electrically-conductive heating element made by coating a cotton fabric sheet with an electrically-conductive polymer (PEDOT) before a voltage has been applied to the heating element, as discussed in EXAMPLE 1.

Surface sheet resistances of 44 Ω/□ and 61 Ω/□ were measured for the PEDOT-coated pineapple fiber and cotton textile substrates, respectively. A battery was connected to the PEDOT-coated heating elements, using alligator clips, to effect Joule heating. A sample of the PEDOT-coated cotton fiber textile substrate was found to be capable of generating a temperature of 28° C. when the ambient temperature was 19° C. when connected to a 4.5-volt battery and to 45° C. when connected to a 6-volt battery. FIG. 20A shows an SEM image of a sample of the PEDOT-coated cotton fiber textile heating element before applying a voltage to the heating element (e.g., before connecting either battery). FIG. 20B shows the same coated cotton fiber textile heating element after being continuously connected to the 4.5-volt battery for one (1) hour under ambient conditions. As can be seen by a comparison of FIGS. 20A and 20B, the PEDOT film on the cotton textile heating element became slightly smoother after one hour of 4.5 volts being applied. However, no dramatic morphology changes, such as cracking, creasing agglomeration or delamination, were observed. This suggests that the PEDOT coating on the cotton fiber textile heating element is rugged and stable enough to maintain its performance when used as a Joule heating element.

As noted above, the PEDOT-coated textile heating elements could be handled like any other commercial fabric in that they could be cut and sewn together (with regular thread) without any detriment to Joule heating performance. FIG. 6 (discussed above) shows a sample of the PEDOT-coated cotton fiber textile heating element heated to 28° C. (with an ambient temperature of 19° C.) using a 4.5 V alkaline battery. FIG. 6 also shows the same fabric swatch after being cut laterally across the heating element with a pair of scissors and sewn back together with a needle and cotton thread. A zig-zag pattern was used to sew the two pieces together so that the seam was obvious. No significant difference in electrothermal response was observed between the original textile heating element and the cut and sewn ample. No hot spots were generated at the sewing points.

Example 2—PEDOT-Coated Heating Element Threads

A reactive vapor deposition apparatus similar to the deposition apparatus described above for EXAMPLE 1 was used for vapor phase polymerization of EDOT to form a PEDOT coating on a usable length of one or more stand-alone fibers or threads. The main structural modification to the reactive vapor deposition apparatus for deposition onto stand-alone fibers or threads was a modification to the deposition stage to include a plurality of thread posts (e.g., as shown in FIG. 9 and discussed above) that allow the fibers or threads to be held in a spaced relationship from the deposition stage in order avoid line-of-sight interference for the EDOT monomer and the oxidant in order to provide for complete or near complete coverage around the entire 360° of the circumference of the fiber or threading substrate. As noted above, the design was meant to mimic an array of thread spools and could accommodate, on average, fibers or threading having a linear length of about seven (7) feet (about 2.1 meters) when the threading was carefully wound in vertical layers.

A thick cotton yarn, similar to those typically used to make sweaters, was vapor coated with a 1.5 μm thick PEDOT film with the modified reactive vapor deposition apparatus to form a heating element thread that can be used in a Joule heating element. FIG. 5 (shown and described above) shows optical micrographs of the pristine, uncoated cotton yard and of the PEDOT-coated cotton yard heating element thread after coating. As can be seen in FIG. 5, the entire circumference of the yam was uniformly coated in one deposition. The PEDOT-coated cotton yam was then plain-woven into a textile sheet (FIG. 10, shown and described above). The vapor-deposited PEDOT coating was not rubbed off during the weaving process, further demonstrating the mechanical robustness of the PEDOT coatings. It is also believed that the PEDOT-coated cotton heating element thread can be knitted, complex-woven, or embroidered into different structures and shapes, just like regular yarns, without the PEDOT coating coming off in any appreciable amount, which provides high flexibility for fabricating customized heating elements. The lateral resistance across a 1 cm length of the plain-woven textile sheet was measured at 100Ω. FIGS. 11A-11D (shown and described above) show the electrothermal responses of the plain-woven textile sheet of the PEDOT-coated heating element thread to application of various voltages. Body temperature was reached with 4.5 volts, and 6 volts gave rise to a temperature of 44° C. As noted above, it is believed that the stability of the PEDOT coating during cutting sewing weaving or other ordinary textile processing operations is achieved due to the mechanical robustness from the complete or near complete coating (e.g., around all or nearly all of the 360° of the threading), e.g., as is achieved with chamber pressures greater than 300 mTorr.

Example 3—Heated Glove Incorporating PEDOT-Coated Textile Heating Elements

Figure 21:
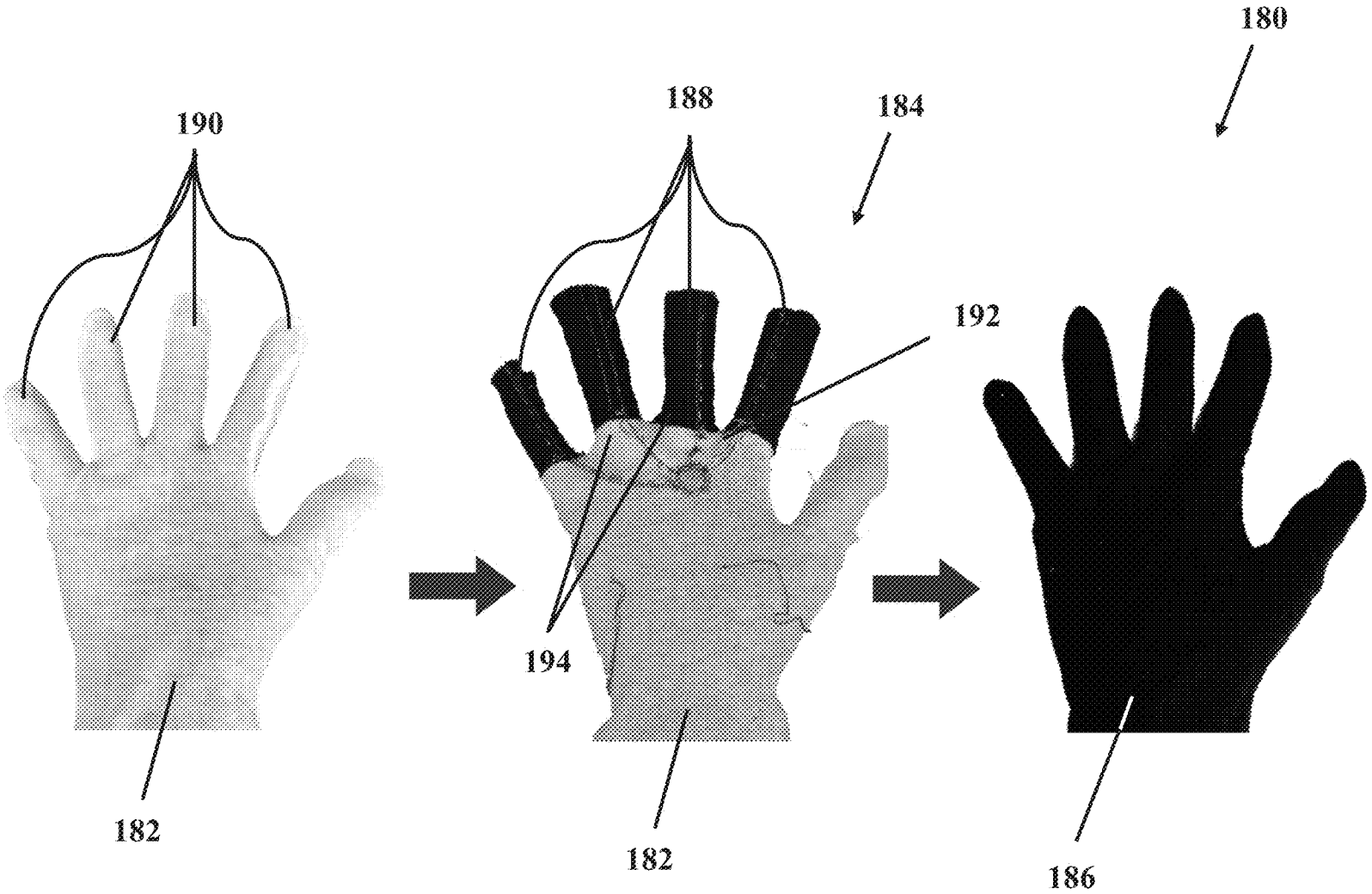
FIG. 21 is a flow diagram of an example of fabricating an example heatable article (i.e., a glove) that incorporates textile-based electrically conductive heating structures, as discussed in EXAMPLE 3.

Layered PEDOT-coated cotton textile heating stacks were used as part of a prototype thermal glove 180. Cotton fiber textile was chosen to fabricate the textile heating elements of the prototype glove because cotton fabric can be thin, breathable, lightweight, and is readily available. FIG. 21 shows a flow diagram of the process of making the prototype glove. The prototype glove 180 included three layered structures: an inner glove layer 182 (also referred to simply as the "inner glove 182"), a middle or active heating structure 184, and an outer cover layer 186 (also referred to as the"outer glove 186").

The inner glove layer 182, e.g., the layer 182 that would contact the wearer's hand, comprised a commercially-available cotton lining glove, which was not coated with PEDOT. The middle heating structure 184 included four separate textile heating elements 188 that were placed over the finger compartments 190 of the inner glove 182. Each textile heating element 188 was made from a double-layered heating stack of cotton textile substrates coated with a 1.5 μm thick PEDOT coating. The two layers of each heating stack heating element were sewn together with conductive copper thread to ensure that there was stable electrical contact between the layers of the heating stack (although as described above, conductive threading is not required). Each double-layered heating stack was curled into a closed cylinder shape corresponding to the size and shape of a corresponding finger compartment 190 of the inner glove 182 (but not the thumb compartment). The heating element cylinders 188 were placed over the finger compartments 190 of the inner glove 182 and were sewn onto the inner glove 182 with conventional, non-PEDOT coated cotton thread. The middle heating structure 184 also included copper fabric contact pads 192. for one or more coin cell batteries (Energizer 1632, weight 1.8 g) were sewn onto the inner glove, one contact pad 192 on the palm side of the inner glove 182 (shown in FIG. 21) and a second contact pad 192 on the back side of the inner glove 182 (not shown in FIG. 21), which served as the positive and negative leads of the one or more batteries.

Conductive copper thread 194 (represented by dashed red lines in FIG. 21 to make the copper threading 194 more visible) was stitched into the inner glove 182 and the cylindrical heating elements 188 of the middle heating structure 184 to provide for electrical connection between the heating elements 188 and the contact pads 192. A first set of four stitch lines of conductive copper thread 194 was stitched into the inner glove 182 on the palm side of the inner glove 182, with each stitch line providing a conduction pathway from the copper fabric contact pad 192 on the palm side to a corresponding one of the heating elements 188 on the finger compartments 190. The first set of stitch lines corresponded to the electrical connection between the positive lead(s) of the one or more batteries at the copper fabric contact pad 192 and the PEDOT-coated textile heating elements 188 on the finger compartments 192. A second set of four stitch lines of the conductive copper thread 194 was stitched into the inner glove 182 on the back side (which is not shown in FIG. 21), with each second stitch line providing a conduction pathway from the copper fabric contact pad 192 on the back side to a corresponding one of the heating elements 188 on the finger compartments 190. The second set of stitch lines corresponded to the electrical connective between the negative lead(s) of the one or more batteries and the PEDOT-coated textile heating elements 188 on the finger compartments 190. The conductive copper thread lines 194 on the palm side and back side of the inner glove were cross-stitched into place using conventional cotton thread. The conductive copper fabric contact pads 192 and the conductive copper thread 194 did not display Joule heating characteristics—i.e., applying a voltage across the conductive copper fabric or the copper thread did not produce an observable temperature increase. Therefore, the copper fabric contact pads 192 and the copper threads 194 simply served as connective and field-equalization components in the prototype glove 180.

An outer cover layer 186 in the form of a commercially available black silk glove 186 was placed over the cylindrical heating elements 188 on the finger compartments 190, the contact pads 192, the connecting wires 194, and the inner glove 186 to serve as a heat-retaining layer and as an aesthetically-tunable overall packaging layer. However, the present disclosure is not limited to a silk outer glove 186. Rather, any outer casing material can be selected to tailor the glove to the aesthetic and haptic preferences of a potential wearer. Further, if desired, bulky outer layers can be invoked to improve heat retention and manifest warmer temperatures from the Joule heating elements, for example for use in colder environments.

Figure 22:
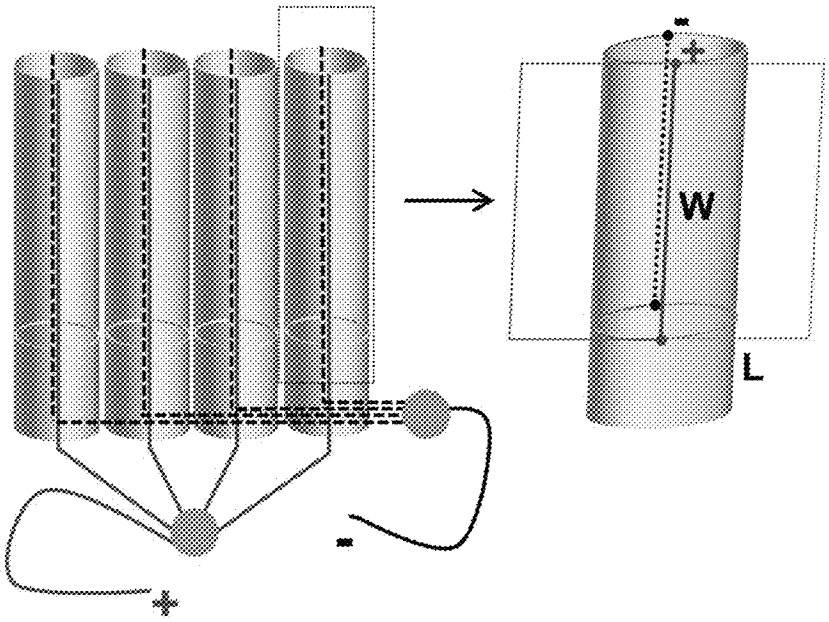
FIG. 22 is a conceptual diagram of an equivalent circuit for the example heatable glove of FIG. 21, as discussed in EXAMPLE 3.

An equivalent circuit for the four cylindrical textile heating element stacks is shown in FIG. 22. For each cylindrical heating stack, one half of the cylinder was considered as a resistor, and each complete cylinder was considered as two resistors connected in parallel when the corresponding stitch lines of conductive thread were formed on the palm side and back side faces of the glove. The complete circuit was equivalent to eight hemi-cylinders connected in parallel, with each hemi-cylinder possessing a resistance of about 80Ω.

Figure 23B:
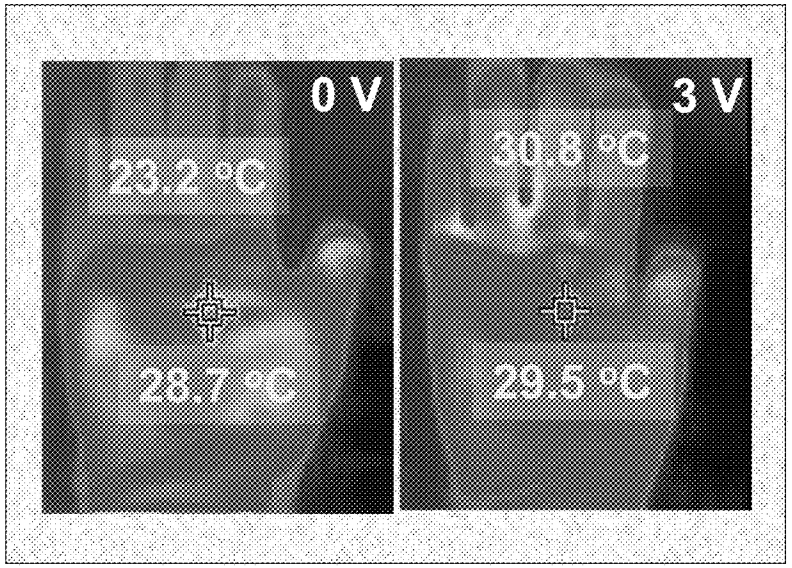
FIG. 23B are thermal-camera images of the example heatable glove of FIG. 21 with no voltage applied and with 3 volts applied when the glove is worn on a human's hand as discussed in EXAMPLE 3.
Figure 23A:
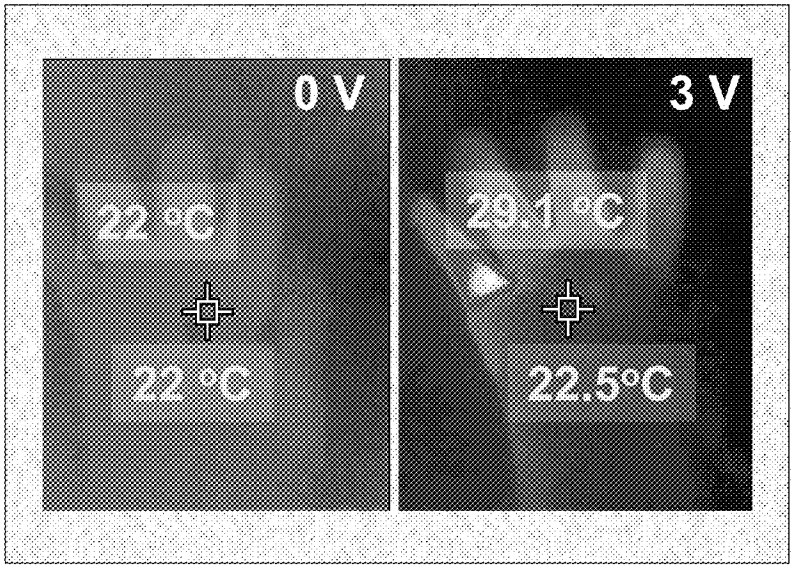
FIG. 23A are thermal-camera images of the example heatable glove of FIG. 21 with no voltage applied and with 3 volts applied when the glove is resting unworn on a table, as discussed in EXAMPLE 3.

FIG. 23A shows thermal camera images of the prototype glove 180 placed on a table before the circuits were connected and voltage was applied from the one or more batteries to the cylindrical heating elements 188 (left image in FIG. 23A) and after the voltage from the one or more batteries (3 V) was applied and the cylindrical heating elements 188 reached equilibrium (right image in FIG. 23A). FIG. 23B shows thermal images of the prototype glove 180 while being worn on a human hand both before applying the voltage (left image in FIG. 23B) and after applyingvoltage to the heating elements 188 from the batteries (right image in FIG. 23B). As can be seen in FIG. 23A, when the prototype glove was unworn, the entire glove showed a uniform temperature equal to the ambient temperature of 22° C. before the voltage was applied. After the circuit was connected and the 3V was applied to the cylindrical heating elements 188, the four finger compartments 190 of glove 180 warmed up to an average temperature of about 29.1° C., and the palm area warmed slightly (and not significantly) to a temperature of about 22.5° C. As can be seen in FIG. 23B, when worn on a hand but before voltage was applied to the cylindrical heating elements over the wearers fingers, the four fingers registered a lower temperature than the areas lacking the overlayers formed by the cylindrical heating elements 188 (e.g., the palm portion of the glove) because less body heat radiated to the surface of the glove through the additional layers of cotton corresponding to the heating element layers 188 (i.e., about 23.2° C. on the surfaces of the finger compartments of the prototype glove compared to about 28.7° C. for the palm area of the glove). When the 3 volts was applied, the four fingers of the glove were warmed up to the be substantially the same temperature as that of the palm area (i.e., about 29.5° C. for the palm area and about 30.8° C. for the finger compartments). The wearer reported feeling the heat being transferred from the fabric heaters to her fingers a few seconds after the voltage was applied.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A heating element composite comprising:

a substrate comprising one or more fibers or threads;

an electrically-conductive polymer coating comprising an electrically-conductive polymer material deposited onto the one or more fibers or threads of the substrate, wherein a thickness of the electrically-conductive polymer coating is at least about 100 nanometers, wherein the electrically-conductive polymer coating covers at least about 75% of an external surface area of the one or more fibers or threads of the substrate, and wherein the heating element composite has a sheet resistance of from about 2 Ω/□ to about 200 Ω/□; and a protective coating comprising an electrically-insulating material covering at least a portion of the electrically-conductive polymer coating, wherein the electrically-insulating material of the protective coating comprises trichloro(1H,1H,2H,2H-perfluorooctyl)silane.

2. A heating element composite according to claim 1, wherein the substrate comprises a fabric thread or yarn.

3. A heating element composite according to claim 1, wherein the substrate comprises a textile sheet comprising the one or more fibers or threads collective arranged to form the textile sheet.

4. A heating element composite according to claim 3, wherein the textile sheet of the substrate comprises a woven fabric sheet or a non-woven fabric sheet.

5. A heating element composite according to claim 1, wherein the thickness of the electrically-conductive polymer coating is at least about 250 nanometers.

6. A heating element composite according to claim 1, wherein the electrically-conductive polymer coating covers at least about 80% of the external surface area of the one or more fibers or threads of the substrate.

7. A heating element composite according to claim 1, wherein the electrically-conductive polymer coating conformally or substantially conformally covers the external surface area of the one or more fibers or threads of the substrate.

8. A heating element composite according to claim 1, wherein the electrically-conductive polymer material comprises poly(3,4-ethylenedioxythiophene).

9. A process comprising the steps of:

coupling a substrate comprising one or more fibers or threads to a deposition stage;

positioning the deposition stage and the substrate in a reactive vapor deposition chamber;

depositing an electrically-conductive polymer material onto the one or more fibers or threads of the substrate in the reactive vapor deposition chamber to form a heating element composite comprising an electrically-conductive polymer coating covering at least a portion of the one or more fibers or threads of the substrate, wherein the electrically-conductive polymer material comprises a vapor-phase polymerization reaction product of one or more precursor compounds deposited via reactive vapor deposition in the reactive vapor deposition chamber; and during the depositing of the electrically-conductive polymer coating, maintaining a deposition pressure in the reactive vapor deposition chamber of at least about 200 mTorr;

wherein the electrically-conductive polymer coating has a thickness of at least about 100 nanometers and the electrically-conductive polymer coating covers at least about 75% of an external surface area of the one or more fibers or threads of the substrate, and wherein the heating element composite has a sheet resistance of from about 2 Ω/□ to about 200 Ω/□.

10. A process according to claim 9, wherein the one or more precursor compounds comprise 3,4-ethylenedioxythiophene and wherein the electrically-conductive polymer material comprises poly(3,4-ethyl enedioxythiophene).

11. A process according to claim 9, wherein the substrate comprises a fabric thread or yarn.

12. A process according to claim 9, wherein the substrate comprises a textile sheet comprising the one or more fibers or threads collective arranged to form the textile sheet.

13. A process according to claim 9, wherein the thickness of the electrically-conductive polymer coating after the step of depositing the electrically-conductive polymer material onto the one or more fibers or threads of the substrate is at least about 250 nanometers.

14. A process according to claim 9, wherein, after the step of depositing the electrically-conductive polymer material onto the one or more fibers or threads of the substrate, the electrically-conductive polymer coating covers at least about 80% of the external surface area of the one or more fibers or threads of the substrate.

15. A process according to claim 9, wherein the electrically-conductive polymer coating conformally or substantially conformally covers the external surface area of the one or more fibers or threads of the substrate.

16. A process according to claim 9, further comprising, after the step of depositing the electrically-conductive polymer material onto the one or more fibers or threads of the substrate, forming a protective coating comprising an electrically-insulating material covering at least a portion of the electrically-conductive polymer coating.

17. A process according to claim 16, wherein the electrically-insulating material of the protective coating comprises trichloro(1H,1H,2H,2H-perfluorooctyl)silane.

18. A process according to claim 16, wherein forming the protective coating comprises depositing the electrically-insulating material onto the heating element composite in a protective coating vapor deposition chamber, wherein the electrically-insulating material of the protective coating comprises a polymerization reaction product of one or more precursor monomers deposited via reactive vapor deposition in the protective coating vapor deposition chamber.

19. A process according to claim 18, wherein the one or more precursor monomers comprise at least one of: one or more acrylic monomers; one or more cyclophane monomers; and one or more siloxane monomers.

* * * * *